US007461918B2

(12) United States Patent
Silverbrook

(10) Patent No.: US 7,461,918 B2
(45) **Date of Patent: *Dec. 9, 2008**

(54) MICRO-ELECTROMECHANICAL INTEGRATED CIRCUIT DEVICE FOR FLUID EJECTION

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 36 days.

This patent is subject to a terminal disclaimer.

(21) Appl. No.: 11/202,344

(22) Filed: Aug. 12, 2005

(65) Prior Publication Data

US 2005/0270326 A1 Dec. 8, 2005

Related U.S. Application Data

(63) Continuation of application No. 10/470,948, filed as application No. PCT/AU02/00068 on Jan. 22, 2002, now Pat. No. 6,969,145.

(30) Foreign Application Priority Data

Feb. 6, 2001 (AU) ..... PR2924

(51) Int. Cl.
*B41J 2/145* (2006.01)
*B41J 2/015* (2006.01)
*B41J 2/135* (2006.01)

(52) U.S. Cl. ..... 347/40; 347/20; 347/44

(58) Field of Classification Search ..... 347/40, 347/20, 21, 28, 44, 45
See application file for complete search history.

(56) References Cited

U.S. PATENT DOCUMENTS 4,417,259 A 11/1983 Maeda
4,736,212 A 4/1988 Oda et al.
5,929,875 A 7/1999 Su et al.
6,281,912 B1 8/2001 Silverbrook
6,328,417 B1 * 12/2001 Silverbrook ..... 347/40
6,412,908 B2 7/2002 Silverbrook
6,460,964 B2 10/2002 Osborne
6,526,658 B1 * 3/2003 Silverbrook ..... 29/890.1
6,679,582 B2 1/2004 Silverbrook
6,988,788 B2 * 1/2006 Silverbrook ..... 347/54
7,125,102 B2 * 10/2006 Silverbrook ..... 347/54

FOREIGN PATENT DOCUMENTS

EP 0604029 B1 4/1998

(Continued)

*Primary Examiner*—Shih-wen Hsieh

(57) ABSTRACT

A micro-electromechanical integrated circuit device includes a substrate that defines a plurality of fluid inlet channels. Drive circuitry is positioned on the substrate. A plurality of fixed nozzle chamber walls is positioned on the substrate about respective fluid inlet channels. A plurality of movable nozzle chamber structures is positioned over respective nozzle chamber walls so that nozzle chambers are defined by the nozzle chamber walls and the nozzle chamber structures. The nozzle chambers are in fluid communication with respective fluid inlet channels and the nozzle chamber structures each define a fluid ejection port. The device includes a plurality of elongate actuators. Each elongate actuator is fast at one end with the substrate to receive electrical signals from the drive circuitry and fast at an opposite end with a respective nozzle chamber structure so that, on receipt of an electrical signal, the actuators are operable to displace the movable nozzle chamber structures towards and away from the substrate so that fluid is ejected from the fluid ejection ports.

6 Claims, 28 Drawing Sheets

FOREIGN PATENT DOCUMENTS

| | | | |
|---|---|---|---|
| EP | 0983855 | A2 | 3/2000 |
| EP | 1057643 | A2 | 12/2000 |
| JP | 01-134107 | | 5/1989 |
| JP | 01-255547 | | 10/1989 |
| JP | 09-216354 | | 8/1997 |
| WO | WO 01/89846 | A | 11/2001 |
| WO | WO 02/49844 | A | 6/2002 |
| WO | WO 02/060695 | A | 8/2002 |

* cited by examiner

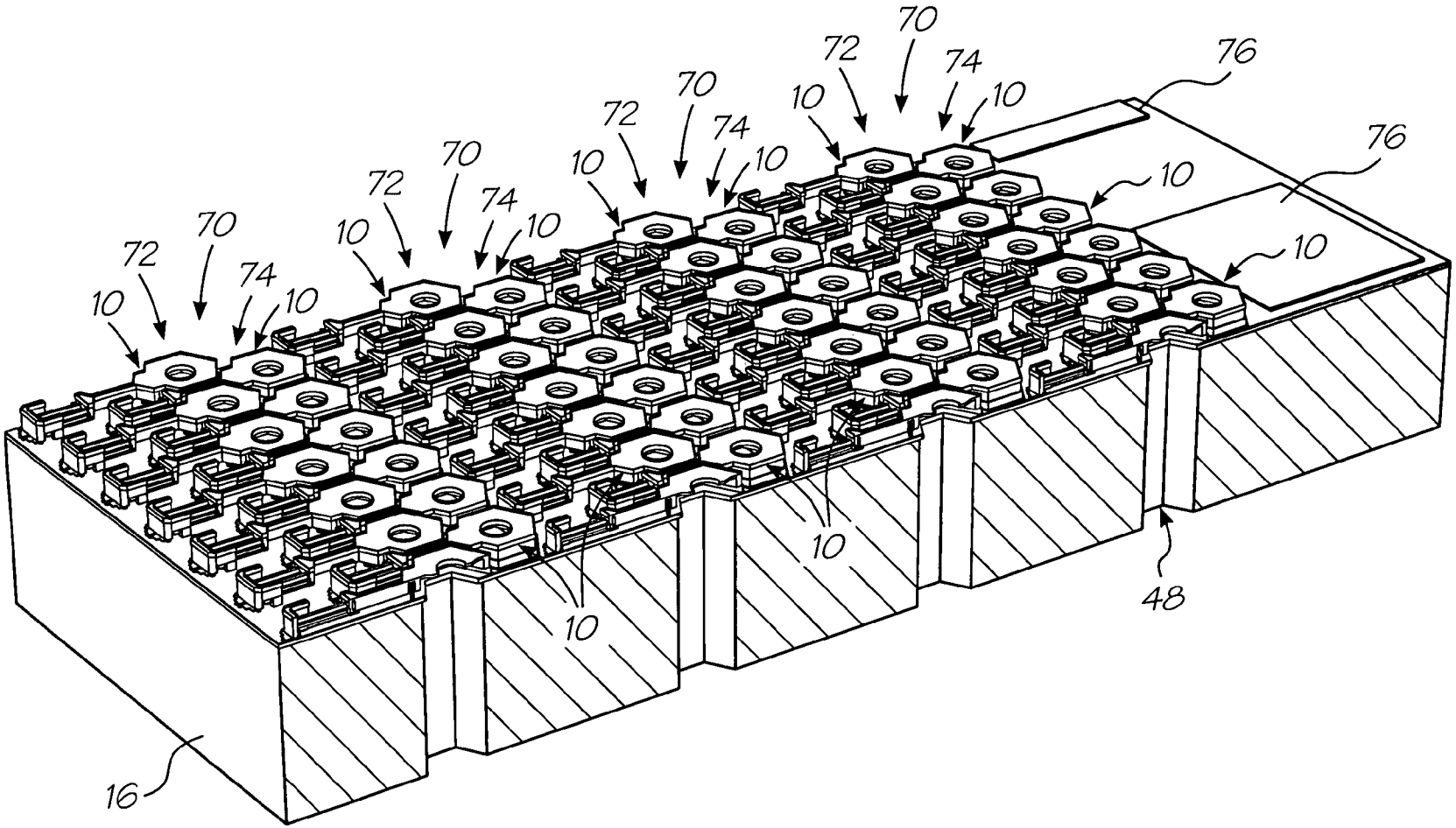
76
76
10
10
10

MICRO-ELECTROMECHANICAL INTEGRATED CIRCUIT DEVICE FOR FLUID EJECTION

CROSS REFERENCE TO RELATED APPLICATION

The present application is a Continuation application of U.S. application Ser. No. 10/470,948 filed on Aug. 8, 2003, which is a National Phase application which is a 371 of PCT/AU02/00068 filed on Jan. 22, 2002, the entire contents of which are herein incorporated by reference.

FIELD OF THE INVENTION

The present invention relates to fluid ejection. In an embodiment, the present invention relates to printed media production and in particular ink jet printers.

BACKGROUND TO THE INVENTION

Ink jet printers are a well-known and widely used form of printed media production. Ink is fed to an array of microprocessor controlled nozzles on a printhead. As the print head passes over the media, ink is ejected from the array of nozzles to produce an image on the media.

Printer performance depends on factors such as operating cost, print quality, operating speed and ease of use. The mass, frequency and velocity of individual ink drops ejected from the nozzles will affect these performance parameters.

Recently, the array of nozzles has been formed using microelectromechanical systems (MEMS) technology, which have mechanical structures with sub-micron thicknesses. This allows the production of printheads that can rapidly eject ink droplets sized in the picolitre ($\times 10^{-12}$ litre) range.

While the microscopic structures of these printheads can provide high speeds and good print quality at relatively low costs, their size makes the nozzles extremely fragile and vulnerable to damage from the slightest contact with fingers, dust or the media substrate. This can make the printheads impractical for many applications where a certain level of robustness is necessary. Furthermore, a damaged nozzle may misdirect the ejected drops or simply fail to eject the ink at all. If the nozzle fails to eject the ink, it can start to bead and affect surrounding nozzles. In time, it may also leak ink onto the printed substrate.

Whether the ejected ink is misdirected or the ink beads on the surface of the printhead, both situations are detrimental to print quality. To address this, the printhead can be provided with an apertured guard over the exterior of the nozzles to avoid damaging contact fingers, dust or the media. However, the guard may also be used to retain misdirected ink droplets or any ink leaked from damaged nozzles. By localizing any ink leakage, the number of nozzles affected can be limited. The guard also prevents misdirected ink droplets from reaching the media.

Unfortunately, the print quality still suffers because it no longer includes the ink from the damaged nozzles. Furthermore, as the containment formation fills with ink, it can still bead on the exterior of the guard to clog the surrounding apertures and or leak onto the media.

SUMMARY OF THE INVENTION

Accordingly, the present invention provides a printhead for an ink jet printer, the printhead including:

a substrate carrying an array of nozzles for ejecting ink onto media to be printed;

an apertured guard positioned over at least one of the nozzles such that ejected ink passes through an aperture and onto the media;

the guard and the nozzle at least partially defining a containment formation for isolating leaked or misdirected ink from the nozzle from at least some of the other nozzles in the array; and means to detect a predetermined amount of ink in the containment formation and stop further supply of ink to the nozzle.

In this specification the term "nozzle" is to be understood as an element defining an opening and not the opening itself.

Preferably, each nozzle in the array has a respective containment formation to isolate it from all the other nozzles in the array and each of the containment formations has one of said detection means. However, some forms of the invention may have a containment formation configured for isolating predetermined groups of nozzles from the other nozzles in the array; wherein the detection means associated with each of the containment formations is configured to stop further supply of ink to the predetermined group upon sensing a predetermined level of ink in the containment formation.

In one form, each of the nozzles use a bend actuator attached to a paddle for ejecting ink wherein the detection means disables the bend actuator to stop further supply of ink to the nozzle.

In a preferred form, the detection means has a pair of electrical contacts positioned in the containment formation such that an accumulation of the predetermined amount of ink closes an electrical circuit such that a comparator disables the actuator.

In some embodiments, the containment formation further includes containment walls extending from the guard to the exterior of each of the nozzles. In a further preferred form, the nozzle guard is formed from silicon.

In one particularly preferred form, the detection means provides feedback for a fault tolerance facility to adjust the operation of other nozzles with the array to compensate for the damaged nozzle.

An ink jet printer printhead according to the present invention, not only isolates any ink leakage such that it is contained to a single nozzle or group of nozzles, but senses the accumulation of ink and stops further supply to that nozzle or group of nozzles. This prevents the supply of ink to damaged nozzles to go unchecked.

The containment walls necessarily use up a proportion of the surface area of the printhead, and this adversely affects the nozzle packing density. The extra printhead chip area required can add 20% to the costs of manufacturing the chip. However, in situations where nozzle manufacture is unreliable, the present invention will maintain print quality despite a relatively high nozzle defect rate.

The nozzle guard may further include fluid inlet openings for directing fluid through the apertures to inhibit the build up of foreign particles on the nozzle array.

The fluid inlet openings may be positioned remote from a bond pad of the nozzle array.

By providing a nozzle guard for the printhead, the nozzle structures can be protected from being touched or bumped against most other surfaces. To optimize the protection provided, the guard forms a flat shield covering the exterior side of the nozzles and has an array of apertures big enough to allow the ejection of ink droplets but small enough to prevent inadvertent contact or the ingress of most dust particles. By forming the shield from silicon, its coefficient of thermal expansion substantially matches that of the nozzle array. This will help to prevent the array of apertures in the shield from falling out of register with the nozzle array as the printhead heats up to it operating temperature. Using silicon also allows the shield to be accurately micro-machined using MEMS techniques. Furthermore, silicon is very strong and substantially non-deformable.

BRIEF DESCRIPTION OF THE DRAWINGS

Preferred embodiments of the invention are now described, by way of example only, with reference to the accompanying drawings in which:

FIG. 5 shows a three dimensional view of a nozzle array constituting an ink jet printhead with a nozzle guard or containment walls;

DETAILED DESCRIPTION OF THE DRAWINGS

Figure 1:
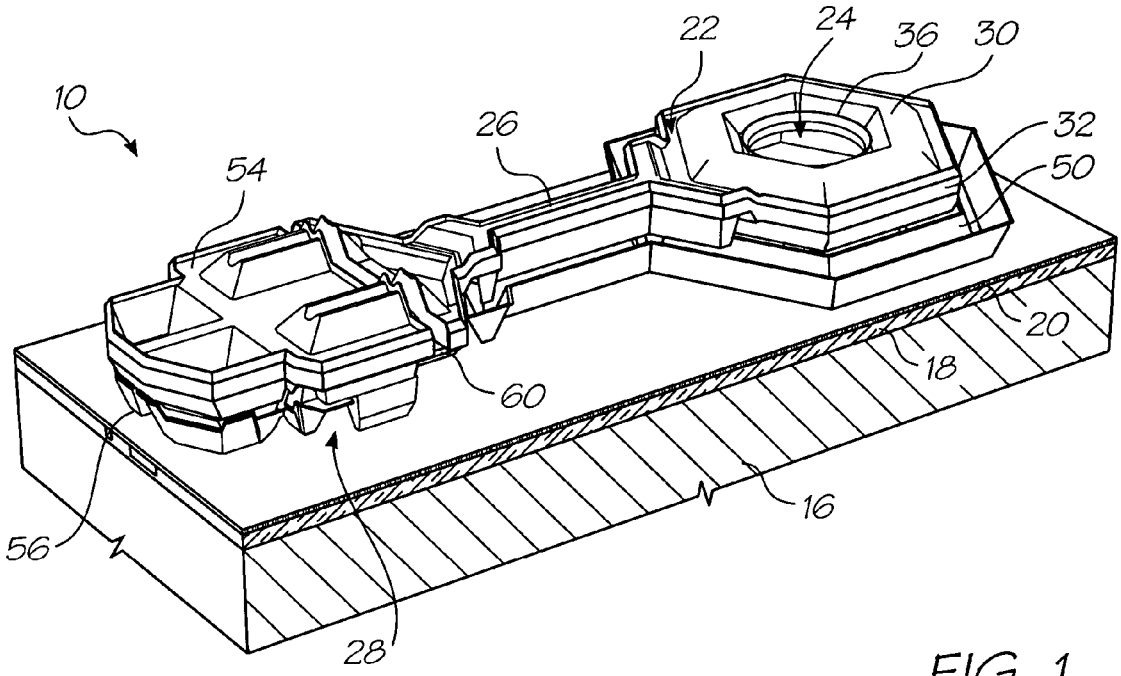
FIG. 1 shows a three dimensional, schematic view of a nozzle assembly for an ink jet printhead.

Referring initially to FIG. 1 of the drawings, a nozzle assembly, in accordance with the invention is designated generally by the reference numeral 10. An ink jet printhead has a plurality of nozzle assemblies 10 arranged in an array 14 (FIGS. 5 and 6) on a silicon substrate 16. The array 14 will be described in greater detail below.

The assembly 10 includes a silicon substrate 16 on which a dielectric layer 18 is deposited. A CMOS passivation layer 20 is deposited on the dielectric layer 18.

Each nozzle assembly 10 includes a nozzle 22 defining a nozzle opening 24, a connecting member in the form of a lever arm 26 and an actuator 28. The lever arm 26 connects the actuator 28 to the nozzle 22.

Figure 2:
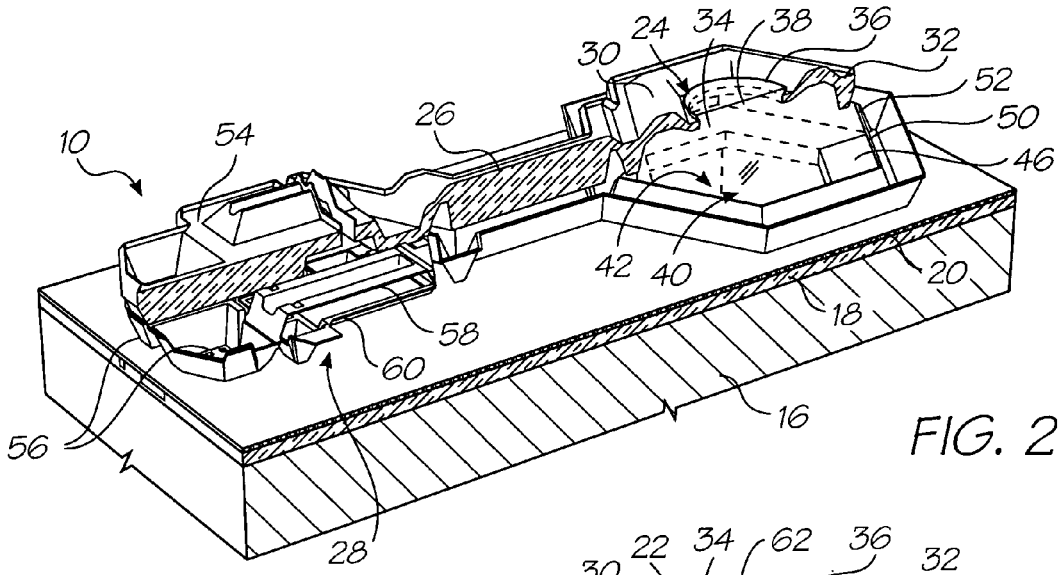
FIGS. 2 to 4 show a three dimensional, schematic illustration of an operation of the nozzle assembly of FIG. 1.
Figure 3:
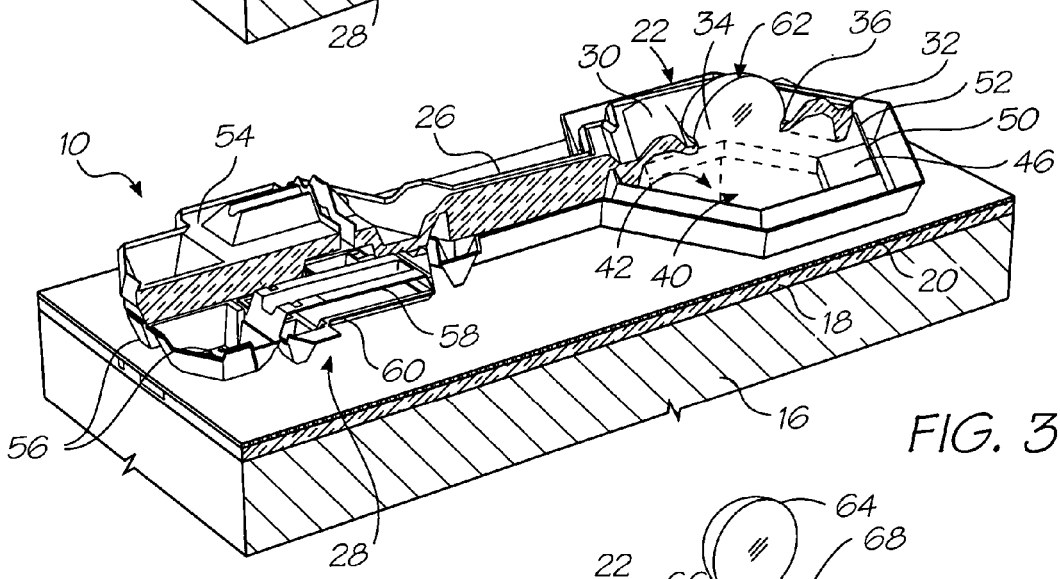
Figure 4:
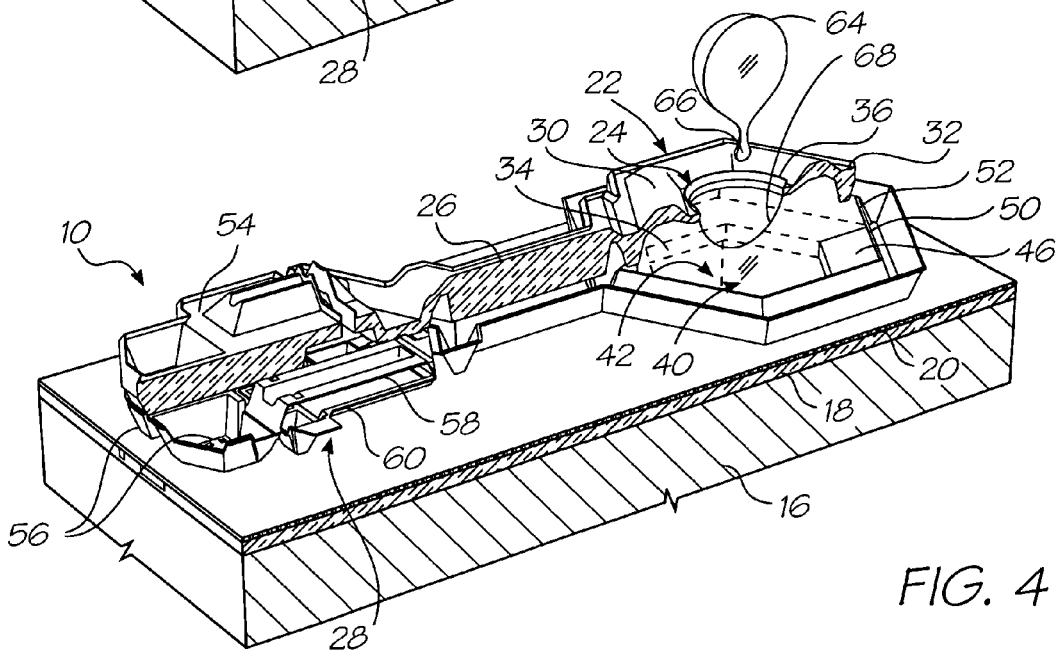

As shown in greater detail in FIGS. 2 to 4, the nozzle 22 comprises a crown portion 30 with a skirt portion 32 depending from the crown portion 30. The skirt portion 32 forms part of a peripheral wall of a nozzle chamber 34. The nozzle opening 24 is in fluid communication with the nozzle chamber 34. It is to be noted that the nozzle opening 24 is surrounded by a raised rim 36 which "pins" a meniscus 38 (FIG. 2) of a body of ink 40 in the nozzle chamber 34.

An ink inlet aperture 42 (shown most clearly in FIG. 6 of the drawings) is defined in a floor 46 of the nozzle chamber 34. The aperture 42 is in fluid communication with an ink inlet channel 48 defined through the substrate 16.

A wall portion 50 bounds the aperture 42 and extends upwardly from the floor portion 46. The skirt portion 32, as indicated above, of the nozzle 22 defines a first part of a peripheral wall of the nozzle chamber 34 and the wall portion 50 defines a second part of the peripheral wall of the nozzle chamber 34.

The wall 50 has an inwardly directed lip 52 at its free end which serves as a fluidic seal which inhibits the escape of ink when the nozzle 22 is displaced, as will be described in greater detail below. It will be appreciated that, due to the viscosity of the ink 40 and the small dimensions of the spacing between the lip 52 and the skirt portion 32, the inwardly directed lip 52 and surface tension function as an effective seal for inhibiting the escape of ink from the nozzle chamber 34.

The actuator 28 is a thermal bend actuator and is connected to an anchor 54 extending upwardly from the substrate 16 or, more particularly from the CMOS passivation layer 20. The anchor 54 is mounted on conductive pads 56 which form an electrical connection with the actuator 28.

The actuator 28 comprises a first, active beam 58 arranged above a second, passive beam 60. In a preferred embodiment, both beams 58 and 60 are of, or include, a conductive ceramic material such as titanium nitride (TiN).

Both beams 58 and 60 have their first ends anchored to the anchor 54 and their opposed ends connected to the arm 26. When a current is caused to flow through the active beam 58 thermal expansion of the beam 58 results. As the passive beam 60, through which there is no current flow, does not expand at the same rate, a bending moment is created causing the arm 26 and, hence, the nozzle 22 to be displaced downwardly towards the substrate 16 as shown in FIG. 3. This causes an ejection of ink through the nozzle opening 24 as shown at 62. When the source of heat is removed from the active beam 58, i.e. by stopping current flow, the nozzle 22 returns to its quiescent position as shown in FIG. 4. When the nozzle 22 returns to its quiescent position, an ink droplet 64 is formed as a result of the breaking of an ink droplet neck as illustrated at 66 in FIG. 4. The ink droplet 64 then travels on to the print media such as a sheet of paper. As a result of the formation of the ink droplet 64, a "negative" meniscus is formed as shown at 68 in FIG. 4 of the drawings. This "negative" meniscus 68 results in an inflow of ink 40 into the nozzle chamber 34 such that a new meniscus 38 (FIG. 2) is formed in readiness for the next ink drop ejection from the nozzle assembly 10.

Figure 5A:
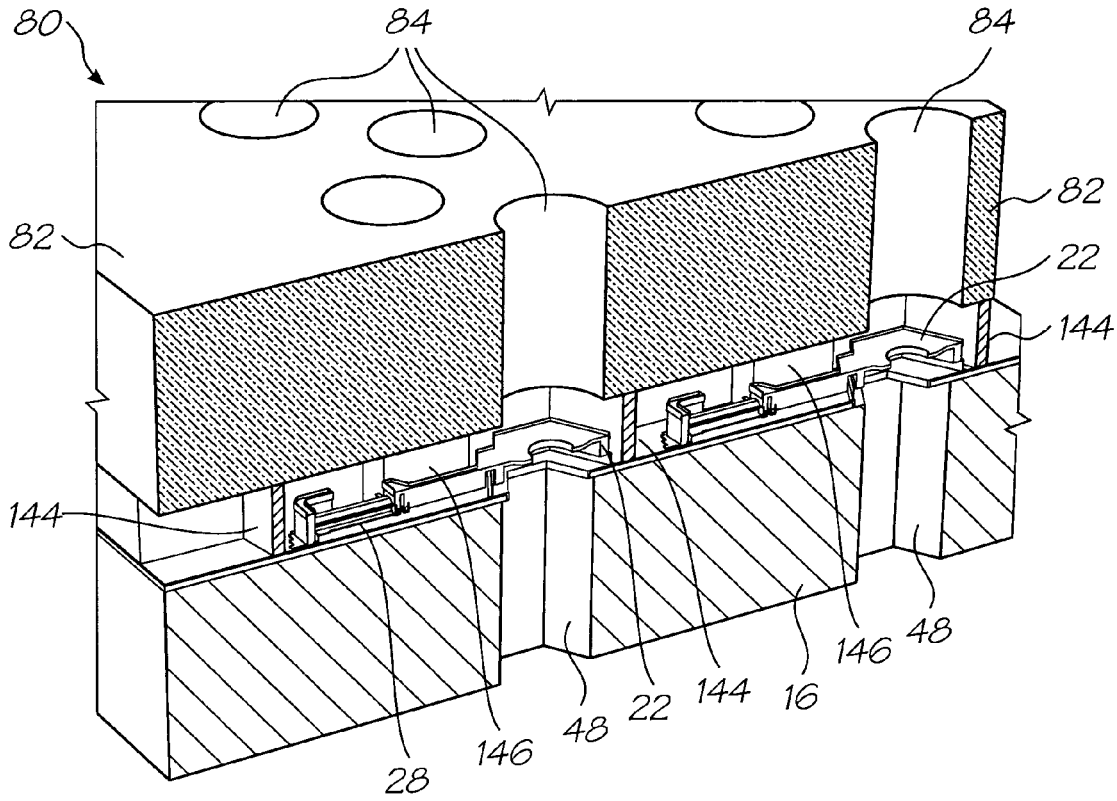
FIG. 5*a* shows a partial sectioned view of a printhead according to the present invention with a nozzle guard and containment walls.
Figure 5B:
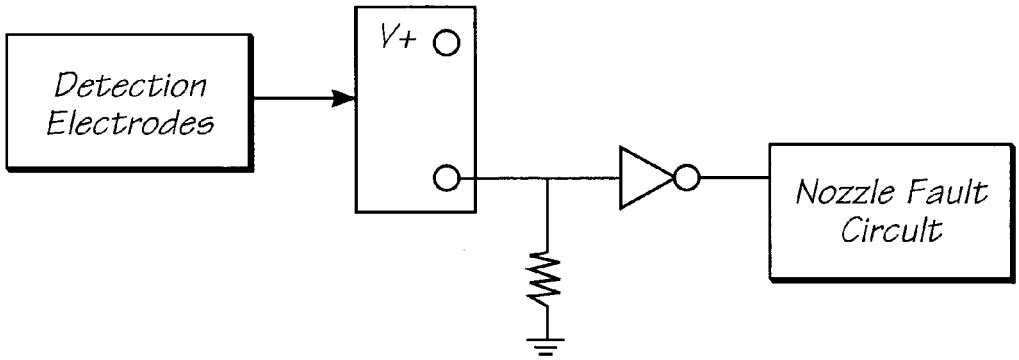
FIG. 5*b* shows a circuit diagram of the ink sensor.
Figure 6:
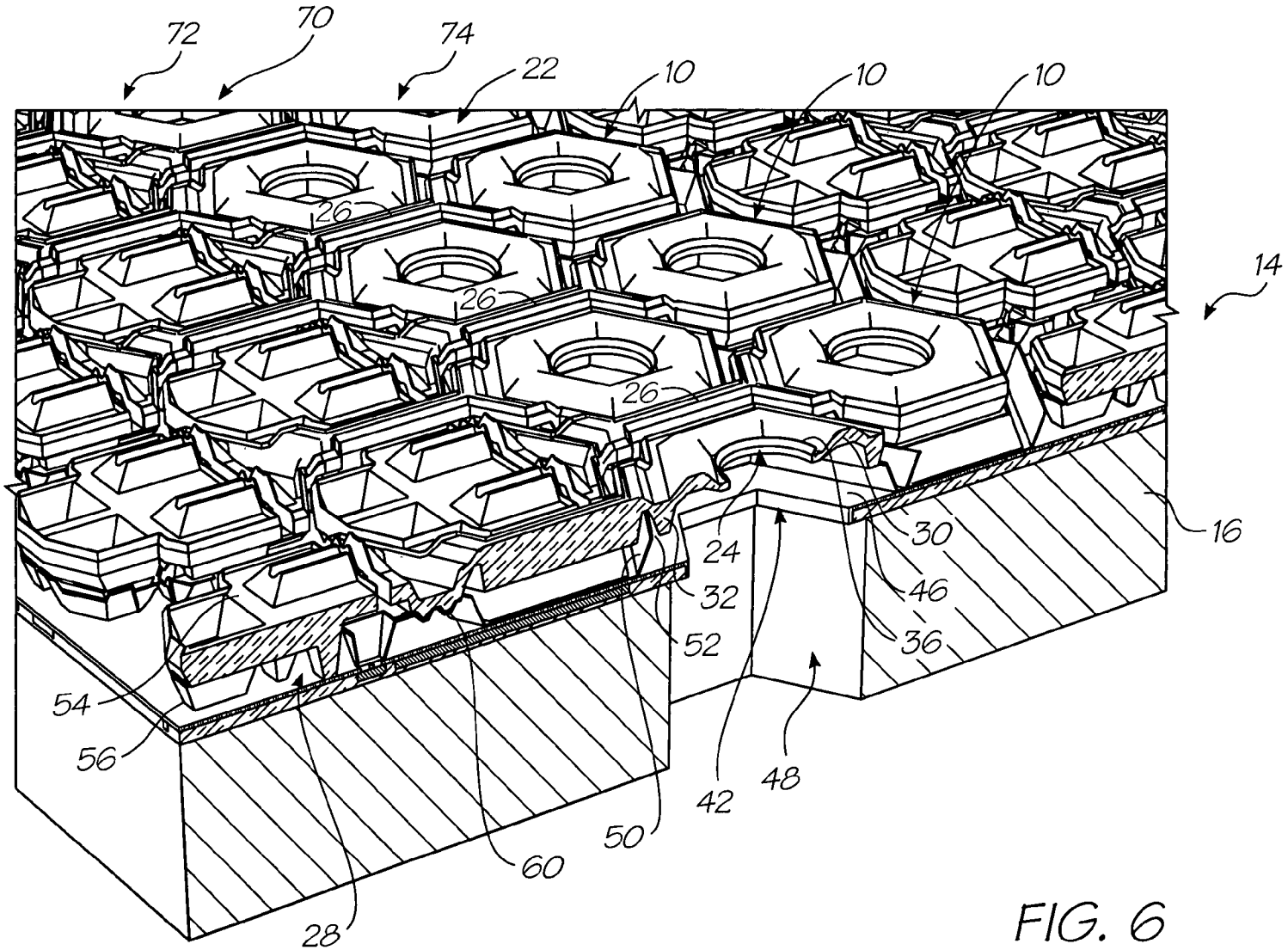
FIG. 6 shows, on an enlarged scale, part of the array of FIG. 5.

Referring now to FIGS. 5 and 6 of the drawings, the nozzle array 14 is described in greater detail. The array 14 is for a four color printhead. Accordingly, the array 14 includes four groups 70 of nozzle assemblies, one for each color. Each group 70 has its nozzle assemblies 10 arranged in two rows 72 and 74. One of the groups 70 is shown in greater detail in FIG. 6.

To facilitate close packing of the nozzle assemblies 10 in the rows 72 and 74, the nozzle assemblies 10 in the row 74 are offset or staggered with respect to the nozzle assemblies 10 in the row 72. Also, the nozzle assemblies 10 in the row 72 are spaced apart sufficiently far from each other to enable the lever arms 26 of the nozzle assemblies 10 in the row 74 to pass between adjacent nozzles 22 of the assemblies 10 in the row 72. It is to be noted that each nozzle assembly 10 is substantially dumbbell shaped so that the nozzles 22 in the row 72 nest between the nozzles 22 and the actuators 28 of adjacent nozzle assemblies 10 in the row 74.

Further, to facilitate close packing of the nozzles 22 in the rows 72 and 74, each nozzle 22 is substantially hexagonally shaped.

It will be appreciated by those skilled in the art that, when the nozzles 22 are displaced towards the substrate 16, in use, due to the nozzle opening 24 being at a slight angle with respect to the nozzle chamber 34 ink is ejected slightly off the perpendicular. It is an advantage of the arrangement shown in FIGS. 5 and 6 of the drawings that the actuators 28 of the nozzle assemblies 10 in the rows 72 and 74 extend in the same direction to one side of the rows 72 and 74. Hence, the ink ejected from the nozzles 22 in the row 72 and the ink ejected from the nozzles 22 in the row 74 are offset with respect to each other by the same angle resulting in an improved print quality.

Also, as shown in FIG. 5 of the drawings, the substrate 16 has bond pads 76 arranged thereon which provide the electrical connections, via the pads 56, to the actuators 28 of the nozzle assemblies 10. These electrical connections are formed via the CMOS layer (not shown).

Referring to FIGS. 5*a* and 5*b*, the nozzle array 14 shown in FIG. 5 has been spaced to accommodate a containment formation 146 surrounding each nozzle assembly 10. The containment formation 146 includes a containment wall 144 surrounding the nozzle 22 and extending from the silicon substrate 16 to the underside of an apertured nozzle guard 80. If ink is not properly ejected because of nozzle damage, the leakage is confined so as not to affect the function of surrounding nozzles. Referring to specifically to 5*b* each containment formation 146 will have the ability to detect the presence of leaked ink. The detection electrodes are positioned in the containment formation 146 so that a build up of leaked or misdirected ink completes the circuit. This triggers the nozzle fault circuit to stop further actuation of the nozzle array 14. Using a fault tolerance facility, the damaged nozzle 22 can be compensated for by re-assigning the data to be printed to other nozzles in the array 14.

The containment walls 144 necessarily occupy a proportion of the silicon substrate 16 which decreases the nozzle packing density of the array. This in turn increases the production costs of the printhead chip. However where the manufacturing techniques result in a relatively high nozzle attrition rate, individual nozzle containment formations will avoid, or at least minimize any adverse effects to the print quality.

It will be appreciated by those in the art, that the containment formation could also be configured to isolate groups of nozzles. Isolating groups of nozzles provides a better nozzle packing density but compensating for damaged nozzles using the surrounding nozzle groups is more difficult.

Figure 7:
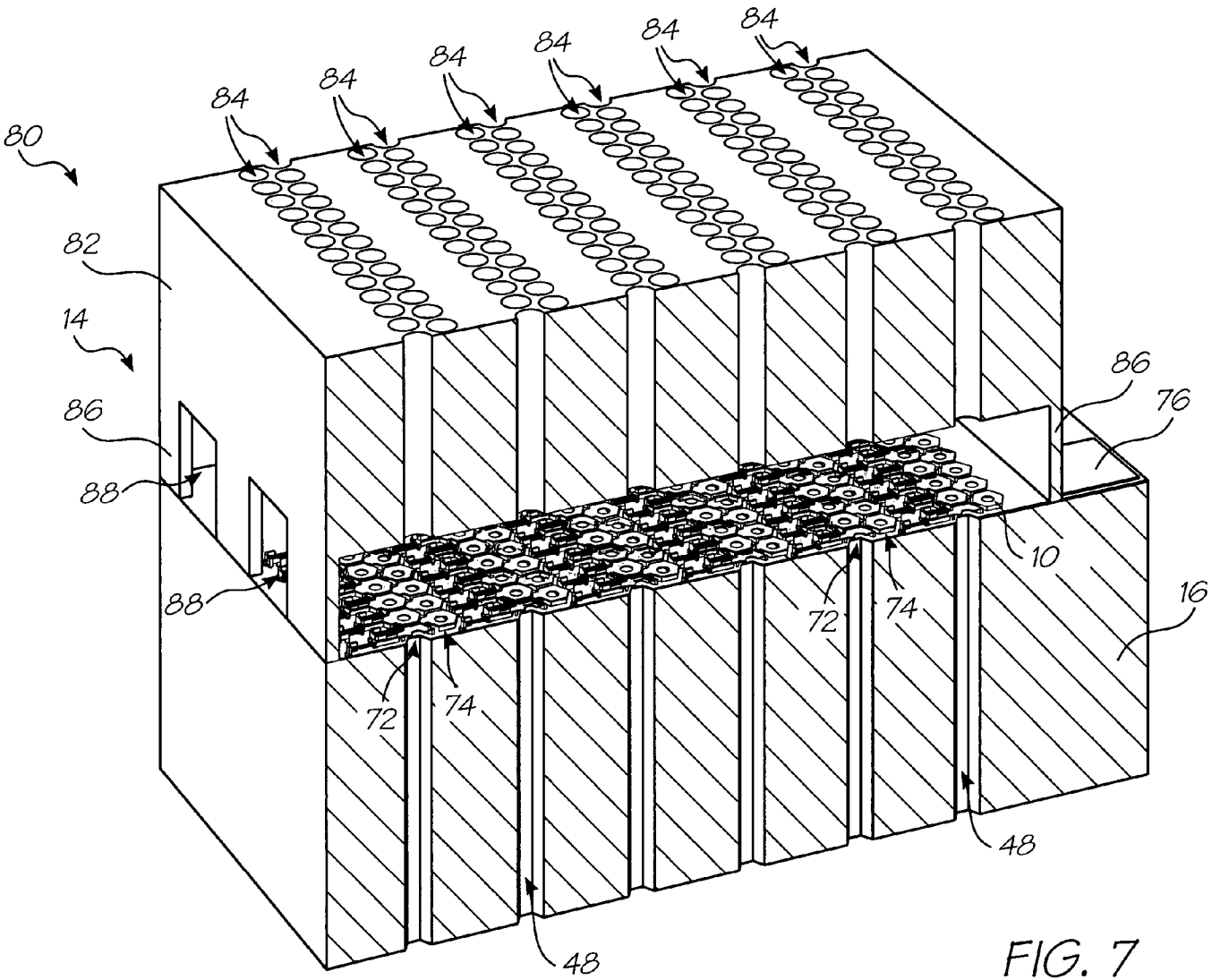
FIG. 7 shows a three dimensional view of an ink jet printhead including a nozzle guard without the containment walls.
Figure 9A:
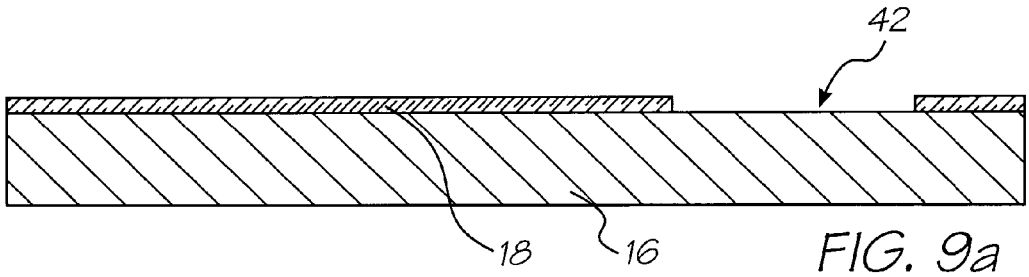
FIGS. 9*a* to 9*r* show sectional side views of the manufacturing steps.
Figure 10A:
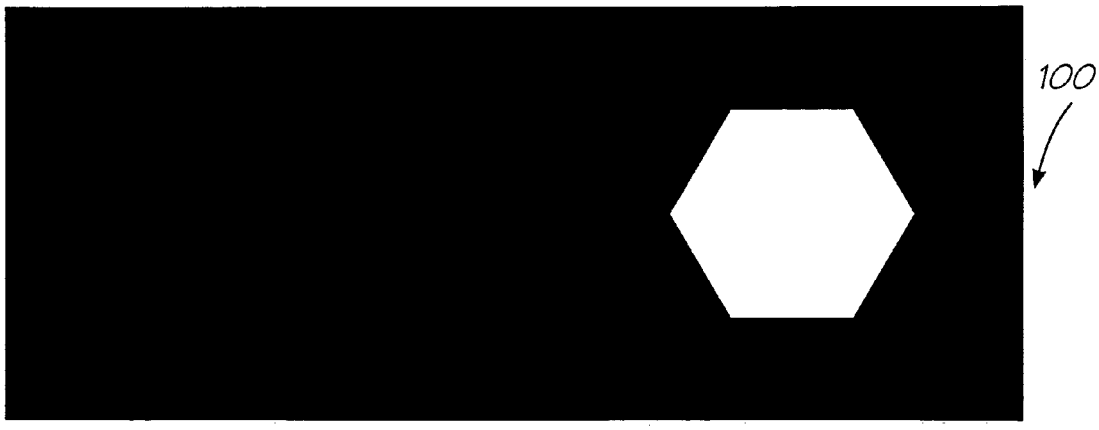
FIGS. 10*a* to 10*k* show layouts of masks used in various steps in the manufacturing process.

Referring to FIG. 7, a nozzle array and a nozzle guard without containment walls is shown. With reference to the previous drawings, like reference numerals refer to like parts, unless otherwise specified.

A nozzle guard 80 is mounted on the silicon substrate 16 of the array 14. The nozzle guard 80 includes a shield 82 having a plurality of apertures 84 defined therethrough. The apertures 84 are in registration with the nozzle openings 24 of the nozzle assemblies 10 of the array 14 such that, when ink is ejected from any one of the nozzle openings 24, the ink passes through the associated passage before striking the print media.

The guard 80 is silicon so that it has the necessary strength and rigidity to protect the nozzle array 14 from damaging contact with paper, dust or the users' fingers. By forming the guard from silicon, its coefficient of thermal expansion substantially matches that of the nozzle array. This aims to prevent the apertures 84 in the shield 82 from falling out of register with the nozzle array 14 as the printhead heats up to its normal operating temperature. Silicon is also well suited to accurate micro-machining using MEMS techniques discussed in greater detail below in relation to the manufacture of the nozzle assemblies 10.

The shield 82 is mounted in spaced relationship relative to the nozzle assemblies 10 by limbs or struts 86. One of the struts 86 has air inlet openings 88 defined therein.

In use, when the array 14 is in operation, air is charged through the inlet openings 88 to be forced through the apertures 84 together with ink traveling through the apertures 84.

The ink is not entrained in the air as the air is charged through the apertures 84 at a different velocity from that of the ink droplets 64. For example, the ink droplets 64 are ejected from the nozzles 22 at a velocity of approximately 3 m/s. The air is charged through the apertures 84 at a velocity of approximately 1 m/s.

The purpose of the air is to maintain the apertures 84 clear of foreign particles. A danger exists that these foreign particles, such as dust particles, could fall onto the nozzle assemblies 10 adversely affecting their operation. With the provision of the air inlet openings 88 in the nozzle guard 80 this problem is, to a large extent, obviated. Referring now to FIGS. 8 to 10 of the drawings, a process for manufacturing the nozzle assemblies 10 is described.

Starting with the silicon substrate or wafer 16, the dielectric layer 18 is deposited on a surface of the wafer 16. The dielectric layer 18 is in the form of approximately 1.5 microns of CVD oxide. Resist is spun on to the layer 18 and the layer 18 is exposed to mask 100 and is subsequently developed.

After being developed, the layer 18 is plasma etched down to the silicon layer 16. The resist is then stripped and the layer 18 is cleaned. This step defines the ink inlet aperture 42.

Figure 8A:
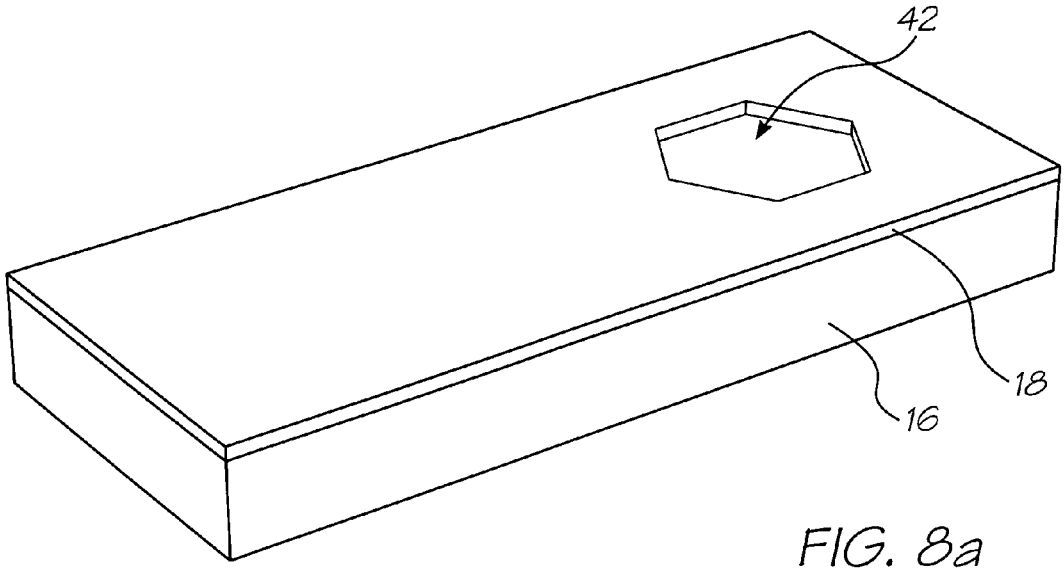
FIGS. 8*a* to 8*r* show three dimensional views of steps in the manufacture of a nozzle assembly of an ink jet printhead.
Figure 8B:
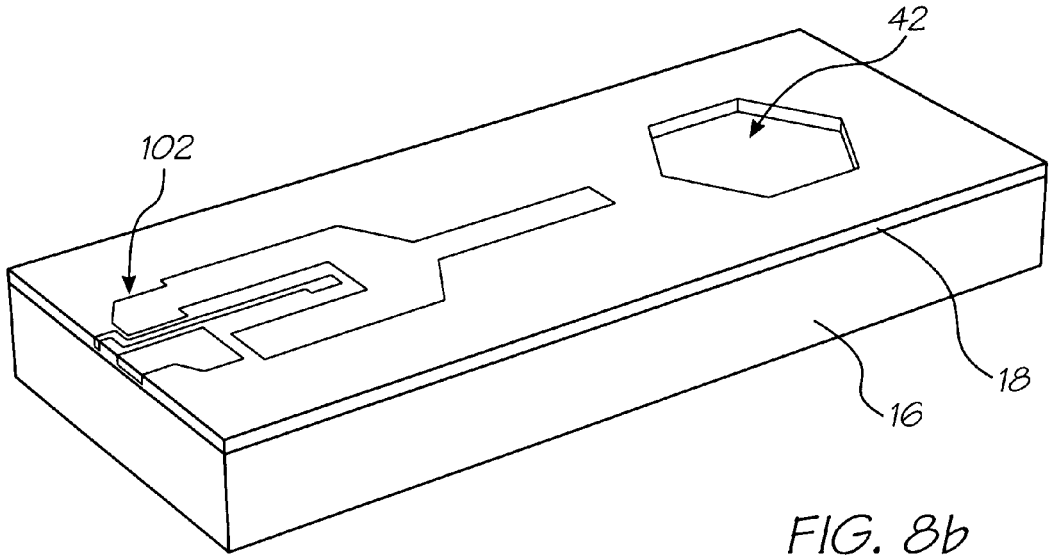
Figure 9B:
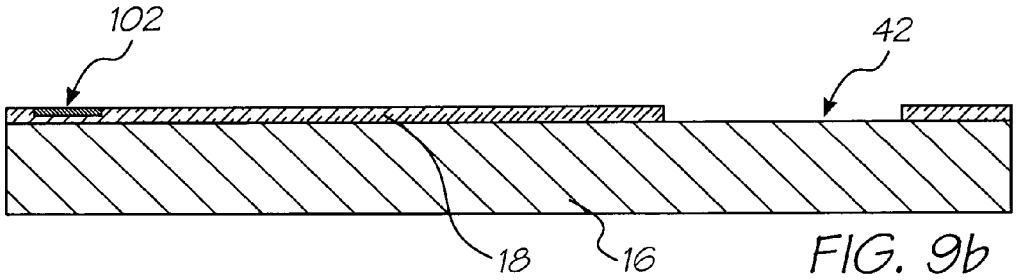
Figure 10B:
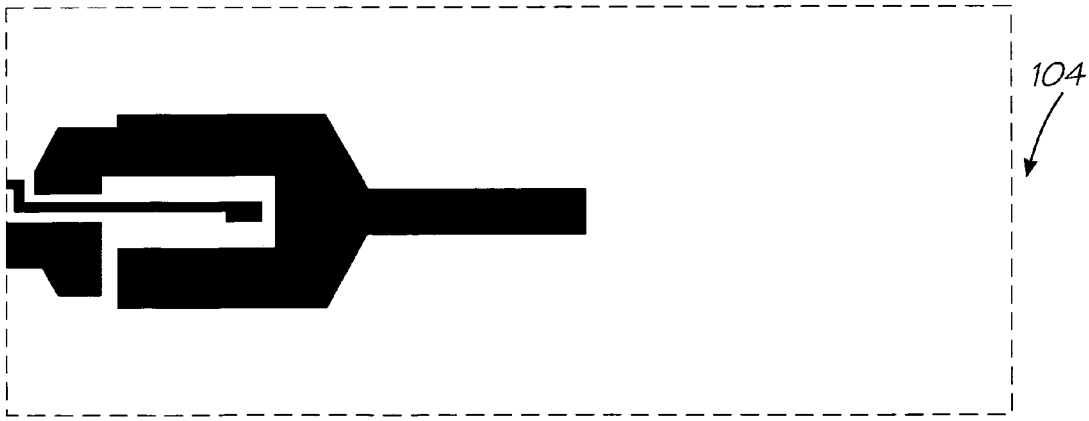
Figure 8C:
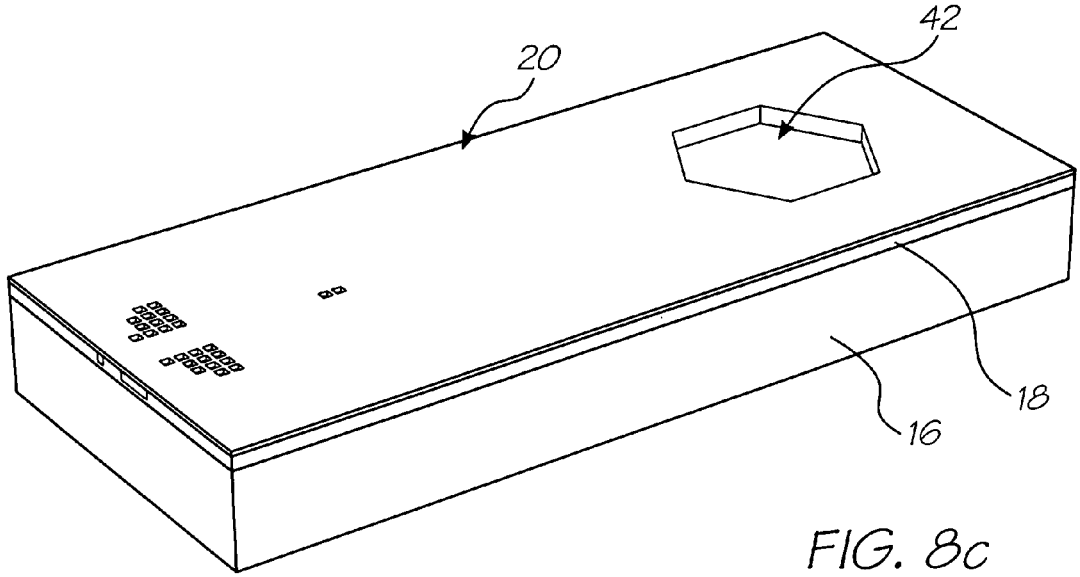
Figure 9C:
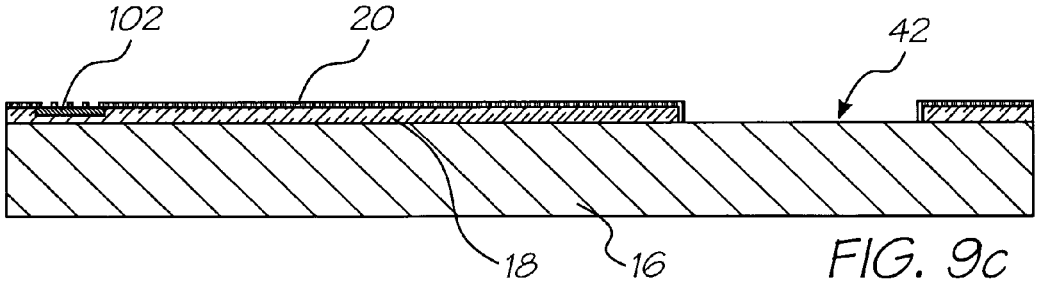
Figure 10C:
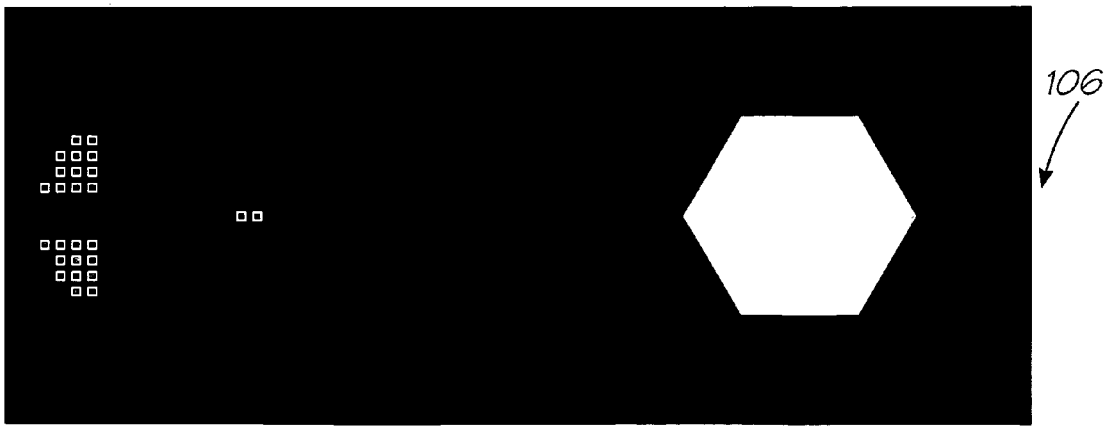
Figure 8D:
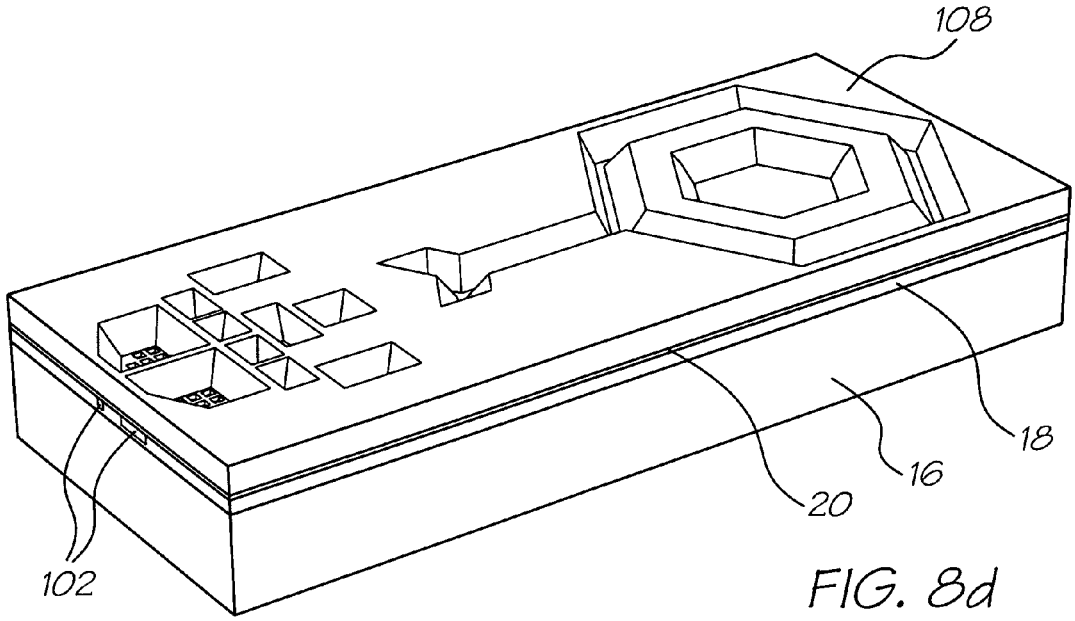
Figure 9D:
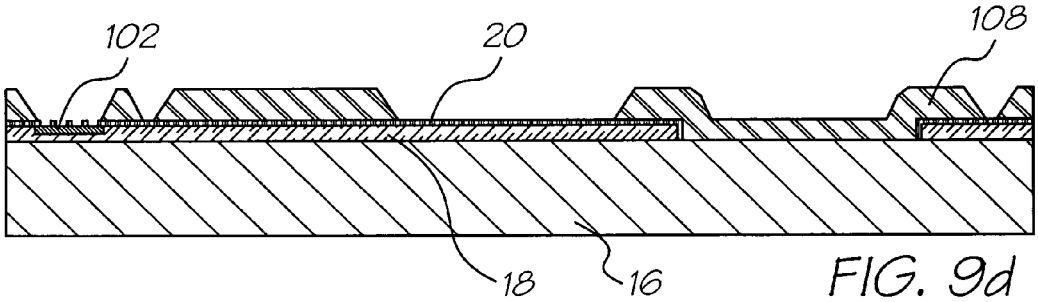
Figure 10D:
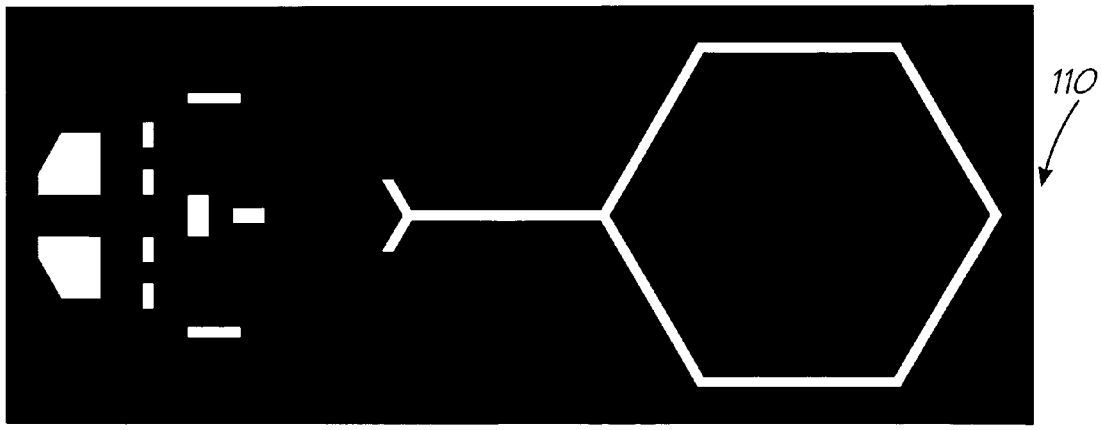

In FIG. 8*b* of the drawings, approximately 0.8 microns of aluminum 102 is deposited on the layer 18. Resist is spun on and the aluminum 102 is exposed to mask 104 and developed. The aluminum 102 is plasma etched down to the oxide layer 18, the resist is stripped and the device is cleaned. This step provides the bond pads and interconnects to the ink jet actuator 28. This interconnect is to an NMOS drive transistor and a power plane with connections made in the CMOS layer (not shown).

Approximately 0.5 microns of PECVD nitride is deposited as the CMOS passivation layer 20. Resist is spun on and the layer 20 is exposed to mask 106 whereafter it is developed. After development, the nitride is plasma etched down to the aluminum layer 102 and the silicon layer 16 in the region of the inlet aperture 42. The resist is stripped and the device cleaned.

A layer 108 of a sacrificial material is spun on to the layer 20. The layer 108 is 6 microns of photo-sensitive polyimide or approximately 4 μm of high temperature resist. The layer 108 is softbaked and is then exposed to mask 110 whereafter it is developed. The layer 108 is then hardbaked at 400° C. for one hour where the layer 108 is comprised of polyimide or at greater than 300° C. where the layer 108 is high temperature resist. It is to be noted in the drawings that the pattern-dependent distortion of the polyimide layer 108 caused by shrinkage is taken into account in the design of the mask 110.

Figure 8E:
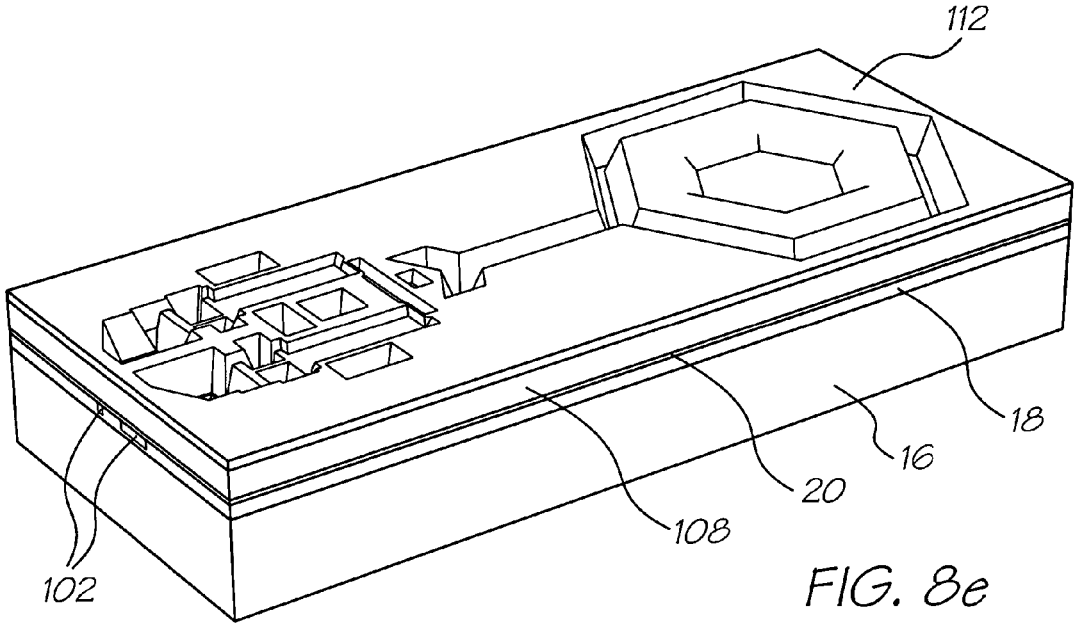
Figure 10E:
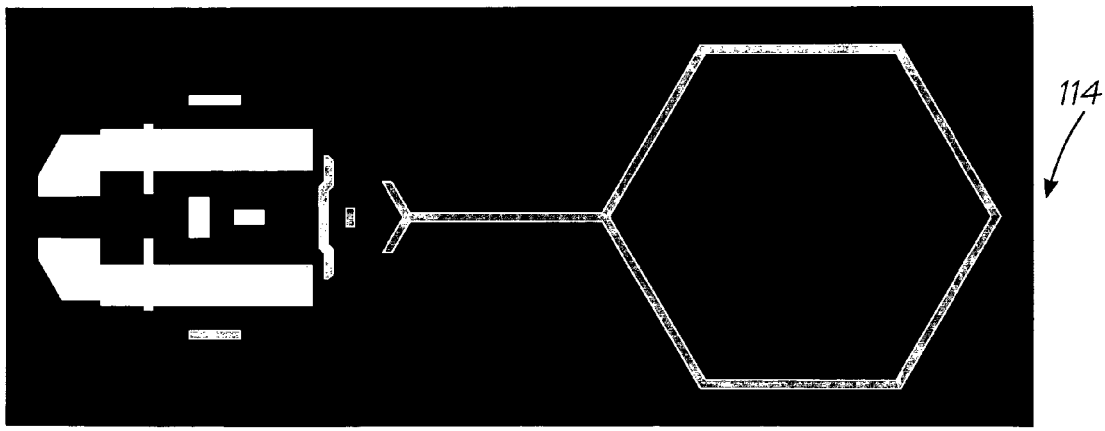
Figure 8F:
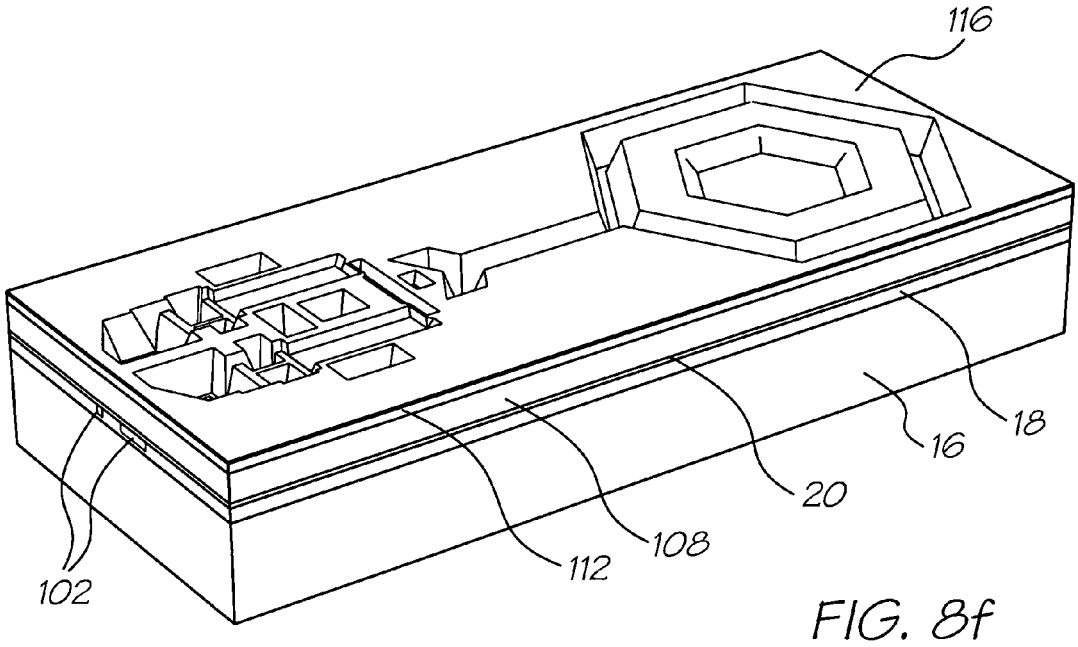
Figure 8G:
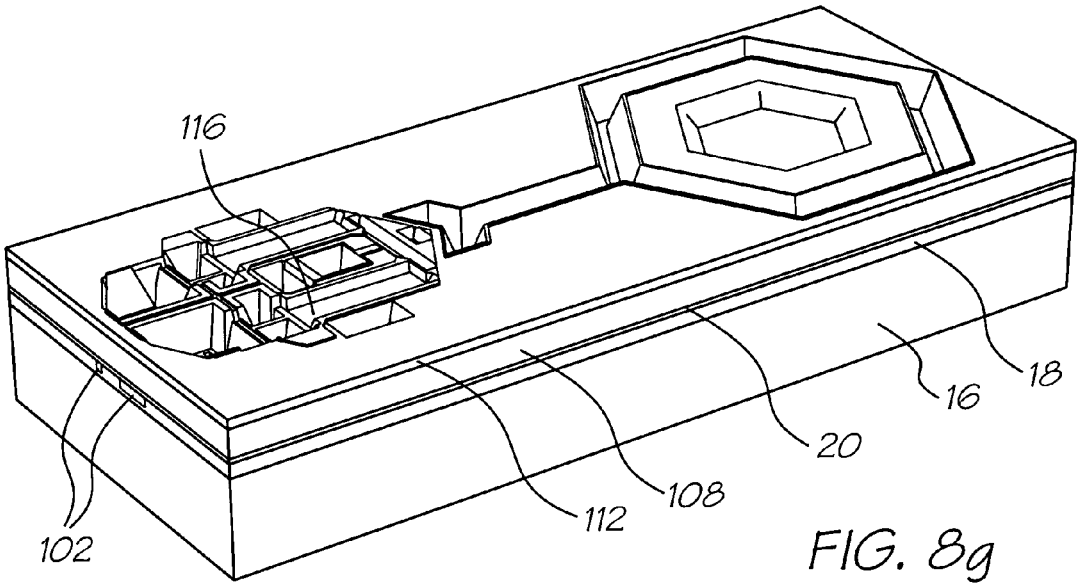
Figure 10F:
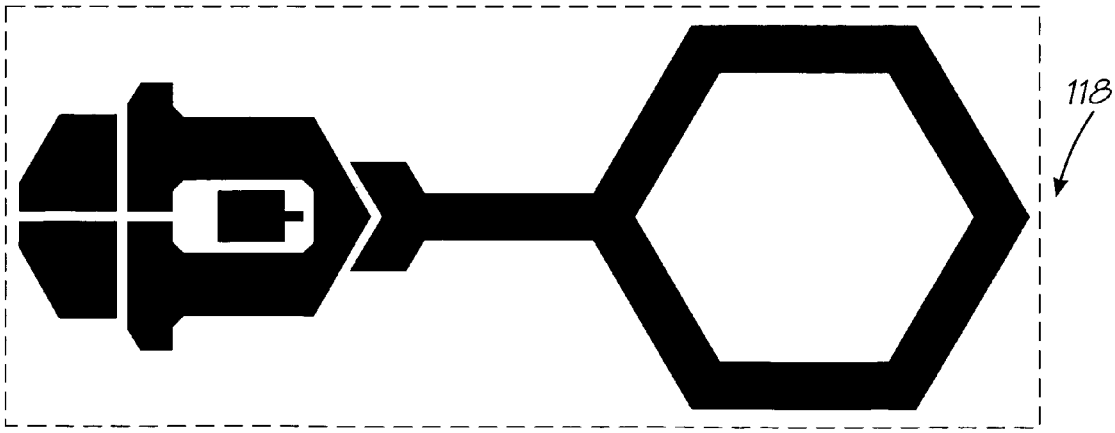
Figure 8H:
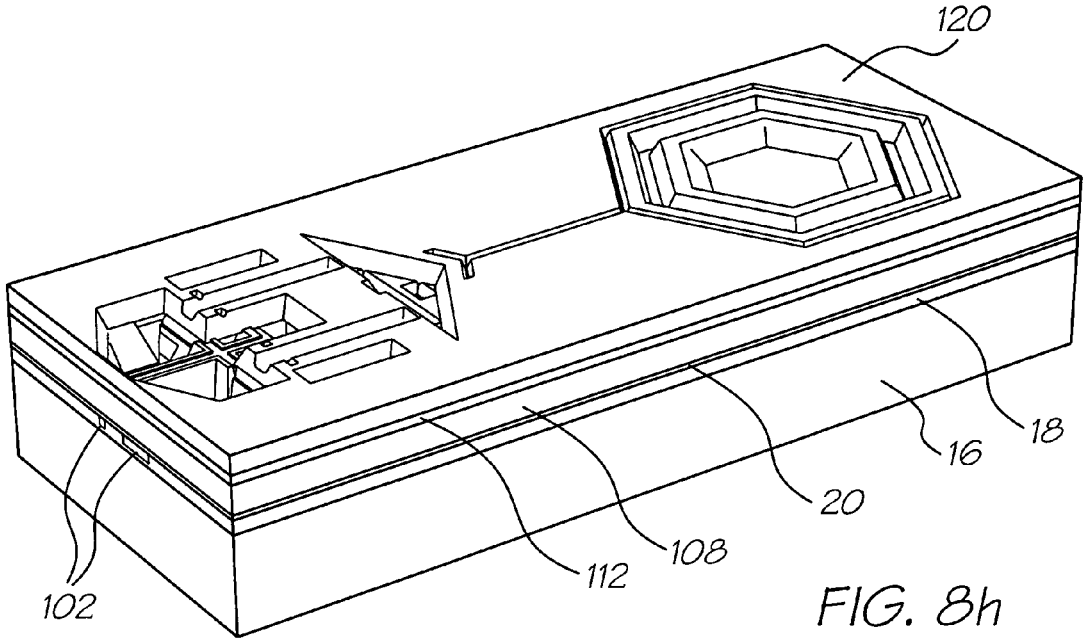
Figure 10G:
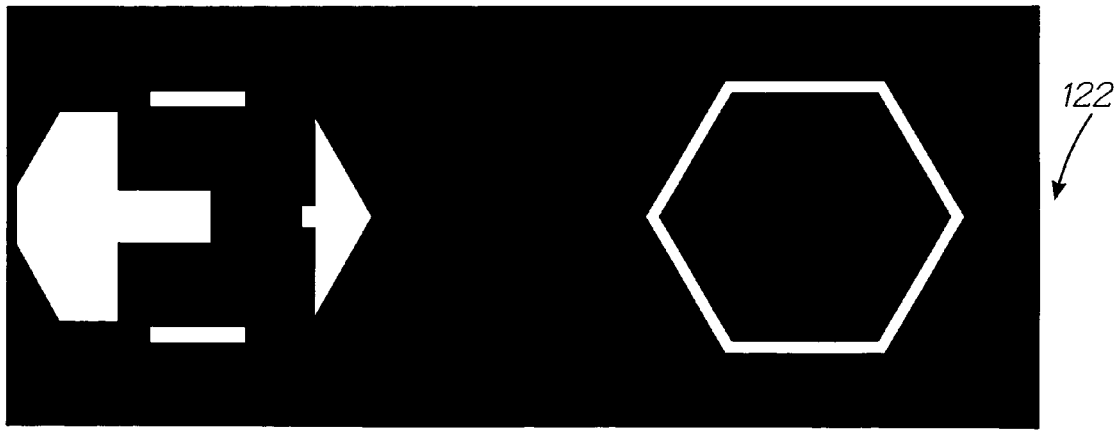
Figure 8I:
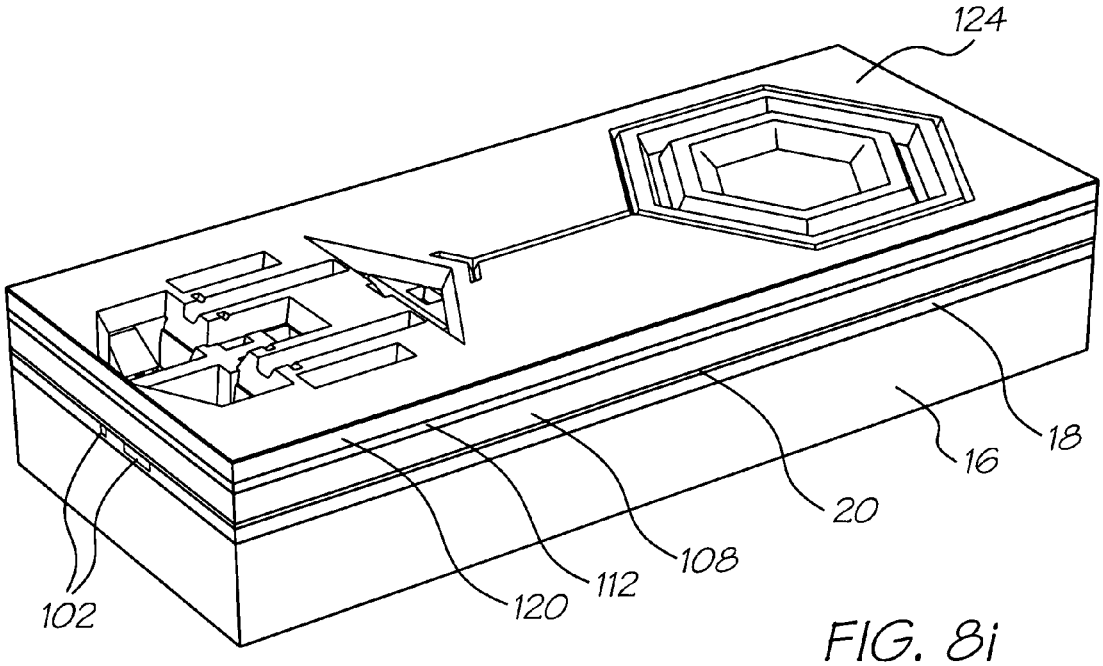
Figure 8J:
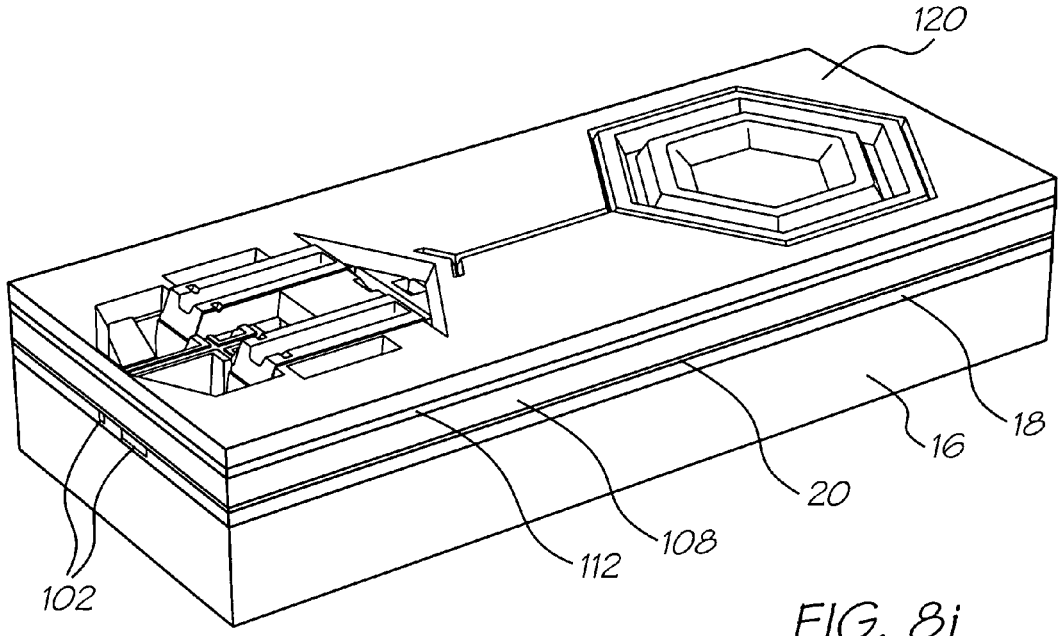
Figure 10H:
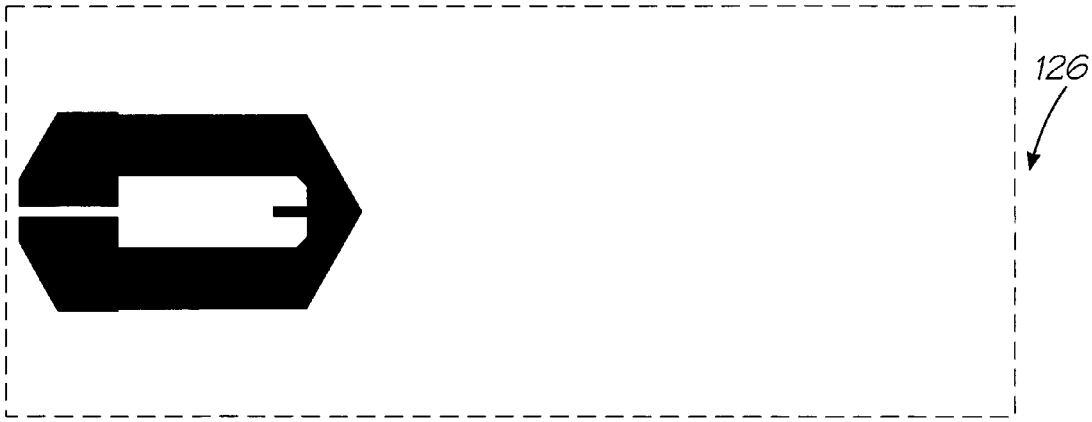
Figure 8K:
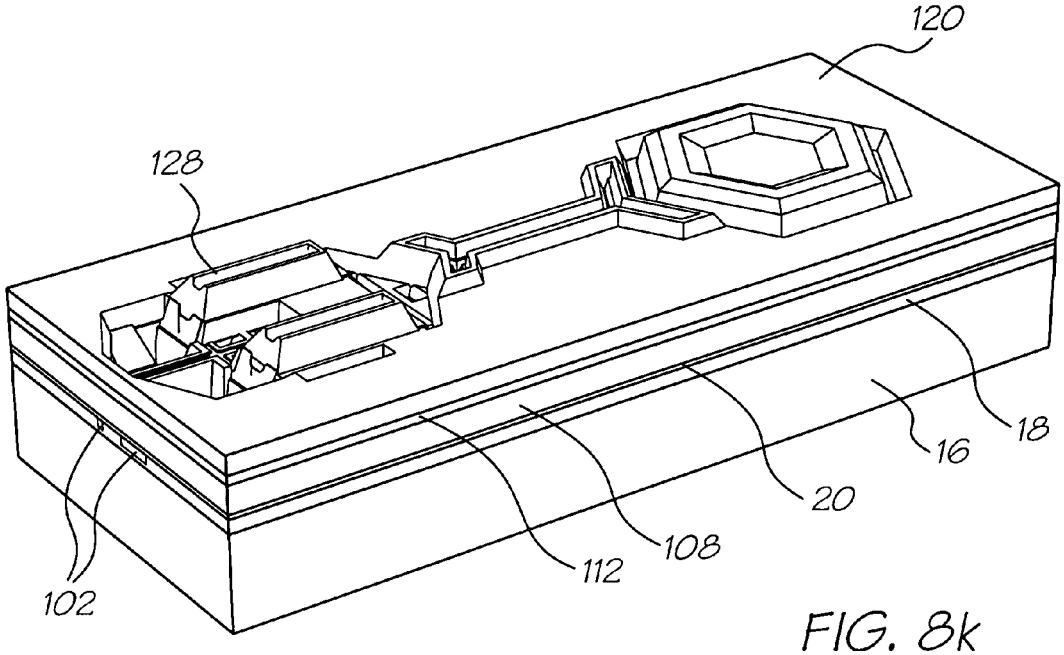

In the next step, shown in FIG. 8*e* of the drawings, a second sacrificial layer 112 is applied. The layer 112 is either 2 μm of photo-sensitive polyimide which is spun on or approximately 1.3 μm of high temperature resist. The layer 112 is softbaked and exposed to mask 114. After exposure to the mask 114, the layer 112 is developed. In the case of the layer 112 being polyimide, the layer 112 is hardbaked at 400° C. for approximately one hour. Where the layer 112 is resist, it is hardbaked at greater than 300° C. for approximately one hour.

A 0.2 micron multi-layer metal layer 116 is then deposited. Part of this layer 116 forms the passive beam 60 of the actuator 28.

The layer 116 is formed by sputtering 1,000 Å of titanium nitride (TiN) at around 300° C. followed by sputtering 50 Å of tantalum nitride (TaN). A further 1,000 Å of TiN is sputtered on followed by 50 Å of TaN and a further 1,000 Å of TiN. Other materials which can be used instead of TiN are $TiB_2$, $MoSi_2$ or (Ti, Al)N.

The layer 116 is then exposed to mask 118, developed and plasma etched down to the layer 112 whereafter resist, applied for the layer 116, is wet stripped taking care not to remove the cured layers 108 or 112.

A third sacrificial layer 120 is applied by spinning on 4 μM of photo-sensitive polyimide or approximately 2.6 μm high temperature resist. The layer 120 is softbaked whereafter it is exposed to mask 122. The exposed layer is then developed followed by hard baking. In the case of polyimide, the layer 120 is hardbaked at 400° C. for approximately one hour or at greater than 300° C. where the layer 120 comprises resist.

A second multi-layer metal layer 124 is applied to the layer 120. The constituents of the layer 124 are the same as the layer 116 and are applied in the same manner. It will be appreciated that both layers 116 and 124 are electrically conductive layers.

The layer 124 is exposed to mask 126 and is then developed. The layer 124 is plasma etched down to the polyimide or resist layer 120 whereafter resist applied for the layer 124 is wet stripped taking care not to remove the cured layers 108, 112 or 120. It will be noted that the remaining part of the layer 124 defines the active beam 58 of the actuator 28.

Figure 9E:
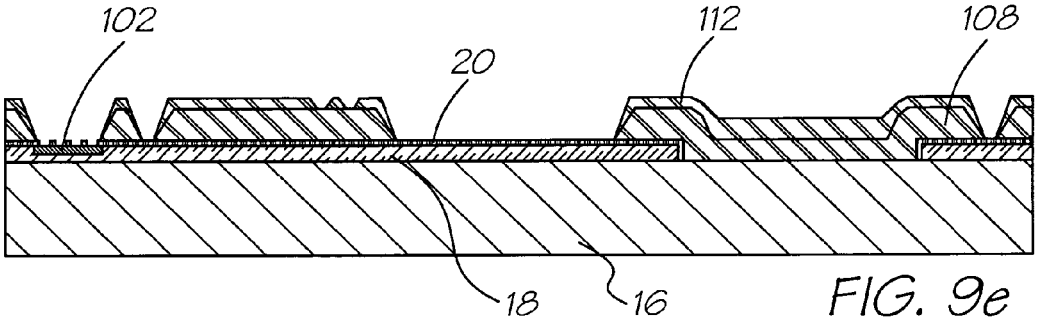
Figure 9F:
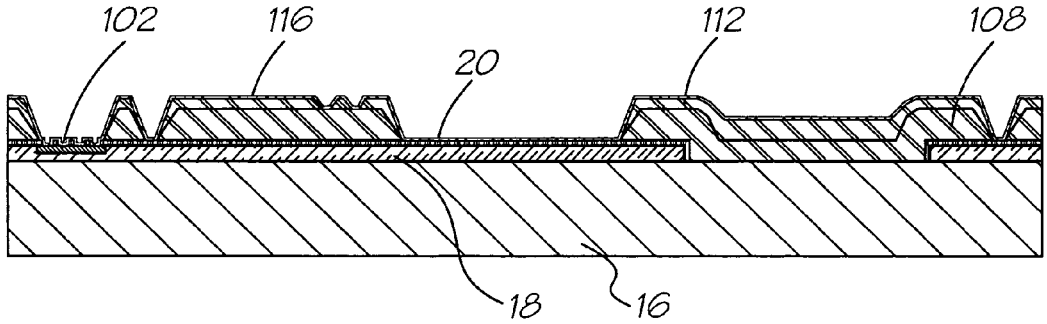
Figure 9G:
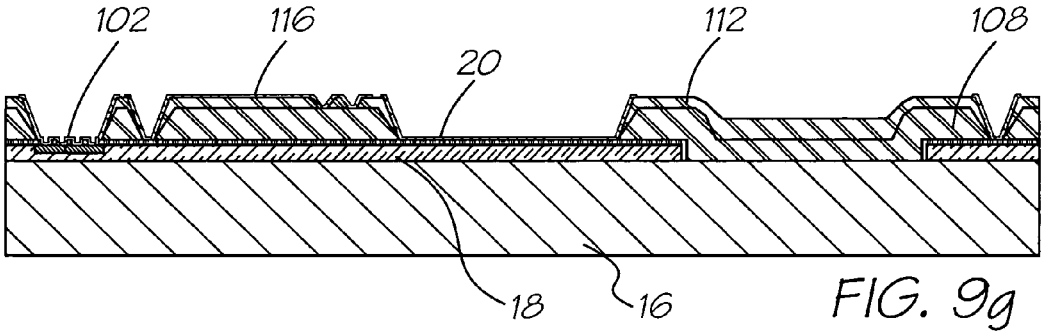
Figure 9H:
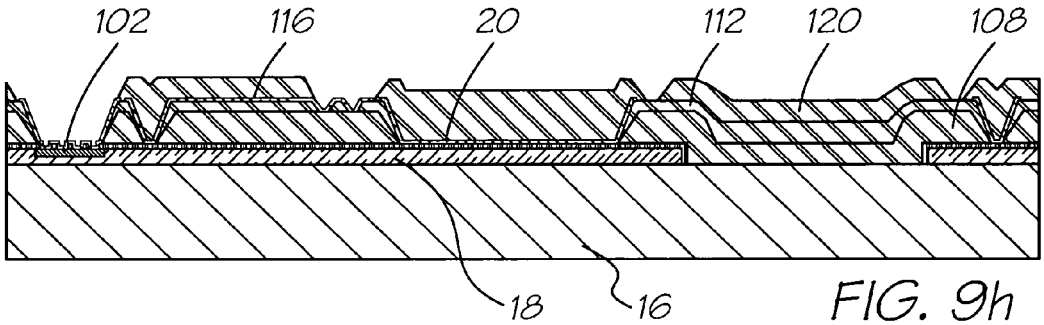
Figure 9I:
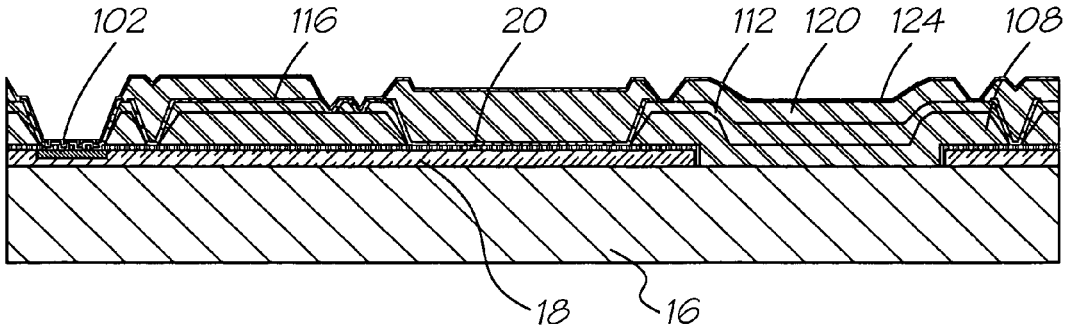
Figure 9J:
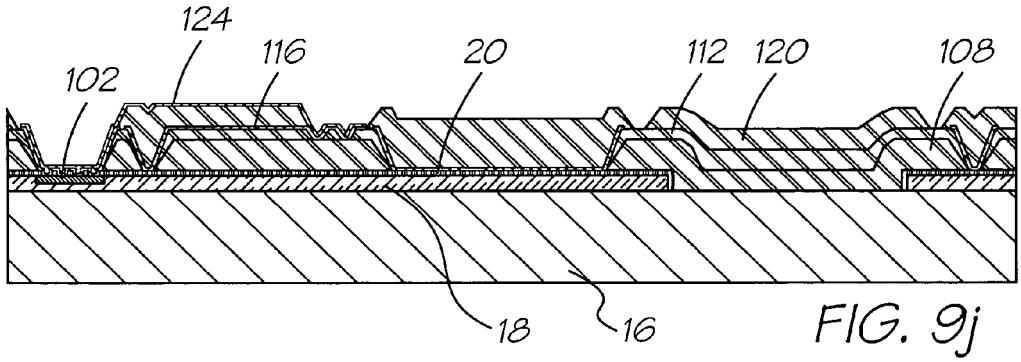
Figure 9K:
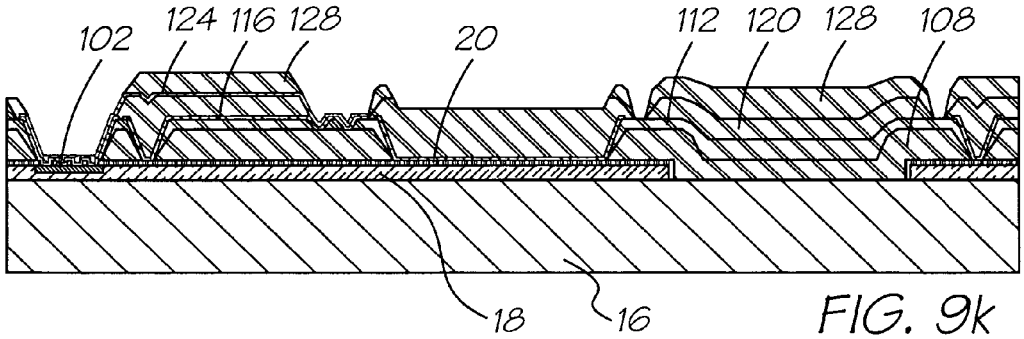
Figure 10I:
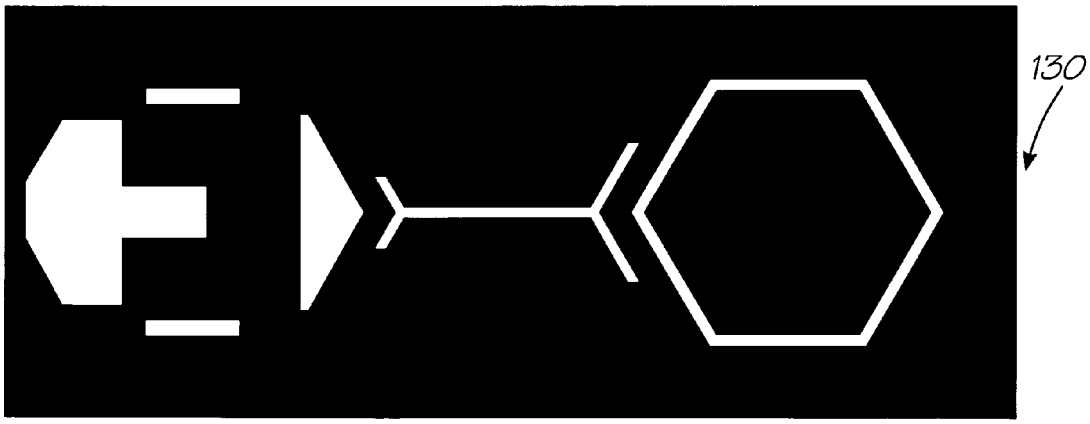

A fourth sacrificial layer 128 is applied by spinning on 4 μm of photo-sensitive polyimide or approximately 2.6 μm of high temperature resist. The layer 128 is softbaked, exposed to the mask 130 and is then developed to leave the island portions as shown in FIG. 9*k* of the drawings. The remaining portions of the layer 128 are hardbaked at 400° C. for approximately one hour in the case of polyimide or at greater than 300° C. for resist.

Figure 81:
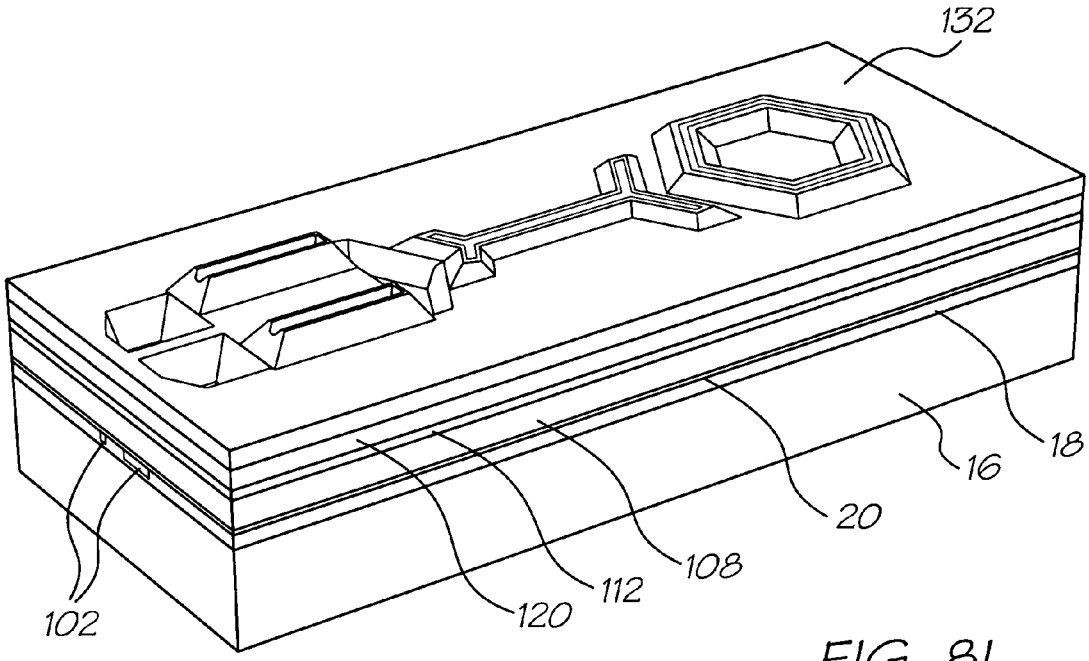
Figure 91:
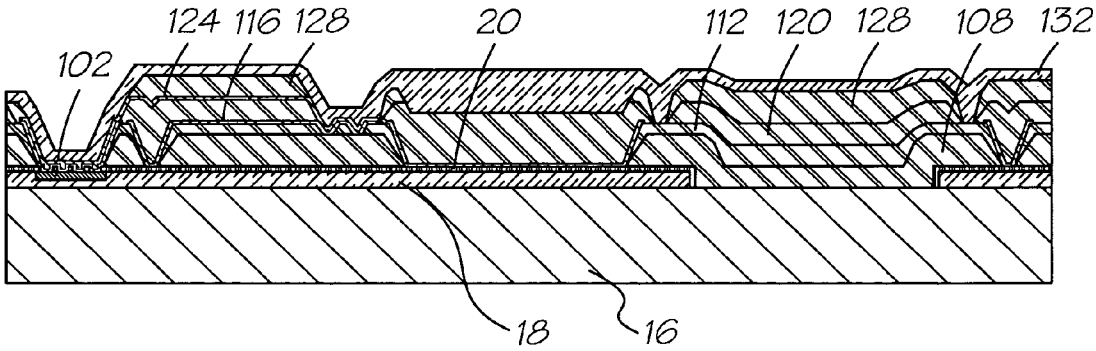
Figure 9M:
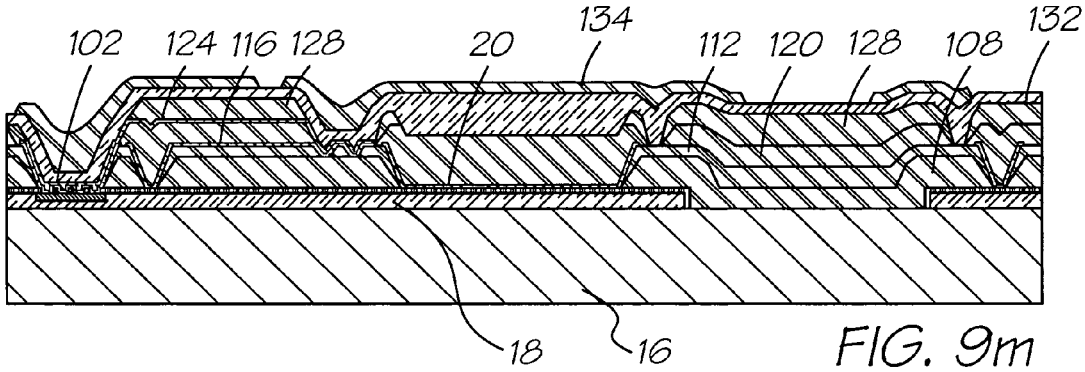
Figure 10J:
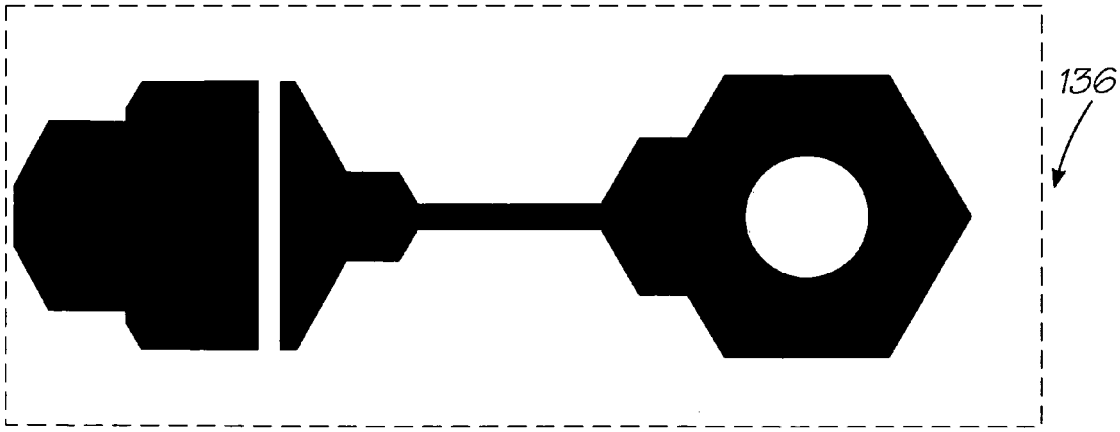
Figure 9N:
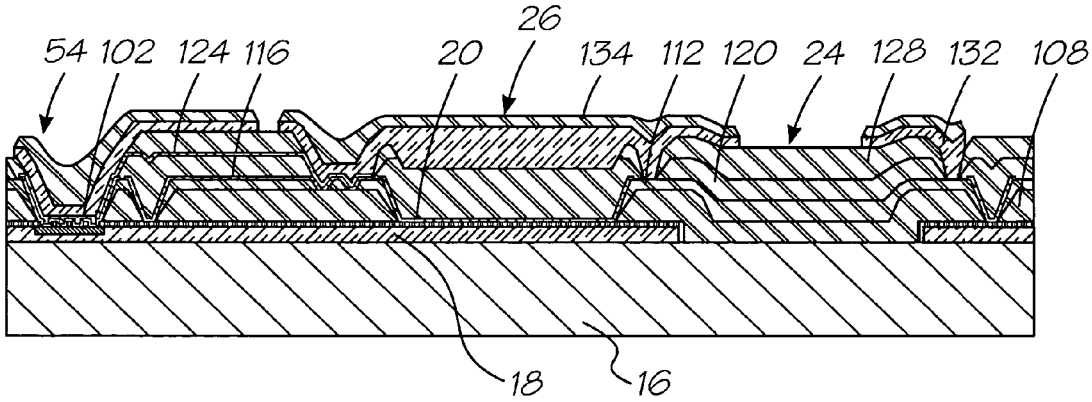
Figure 9O:
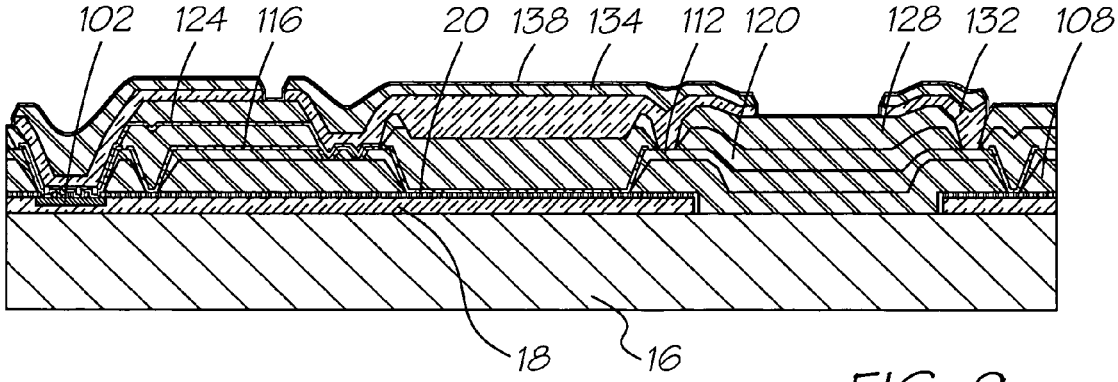

As shown in FIG. 81 of the drawing a high Young's modulus dielectric layer 132 is deposited. The layer 132 is constituted by approximately 1 μm of silicon nitride or aluminum oxide. The layer 132 is deposited at a temperature below the hardbaked temperature of the sacrificial layers 108, 112, 120, 128. The primary characteristics required for this dielectric layer 132 are a high elastic modulus, chemical inertness and good adhesion to TiN.

A fifth sacrificial layer 134 is applied by spinning on 2 μm of photo-sensitive polyimide or approximately 1.3 μm of high temperature resist. The layer 134 is softbaked, exposed to mask 136 and developed. The remaining portion of the layer 134 is then hardbaked at 400° C. for one hour in the case of the polyimide or at greater than 300° C. for the resist.

The dielectric layer 132 is plasma etched down to the sacrificial layer 128 taking care not to remove any of the sacrificial layer 134.

This step defines the nozzle opening 24, the lever arm 26 and the anchor 54 of the nozzle assembly 10.

A high Young's modulus dielectric layer 138 is deposited. This layer 138 is formed by depositing 0.2 μm of silicon nitride or aluminum nitride at a temperature below the hardbaked temperature of the sacrificial layers 108, 112, 120 and 128.

Figure 8M:
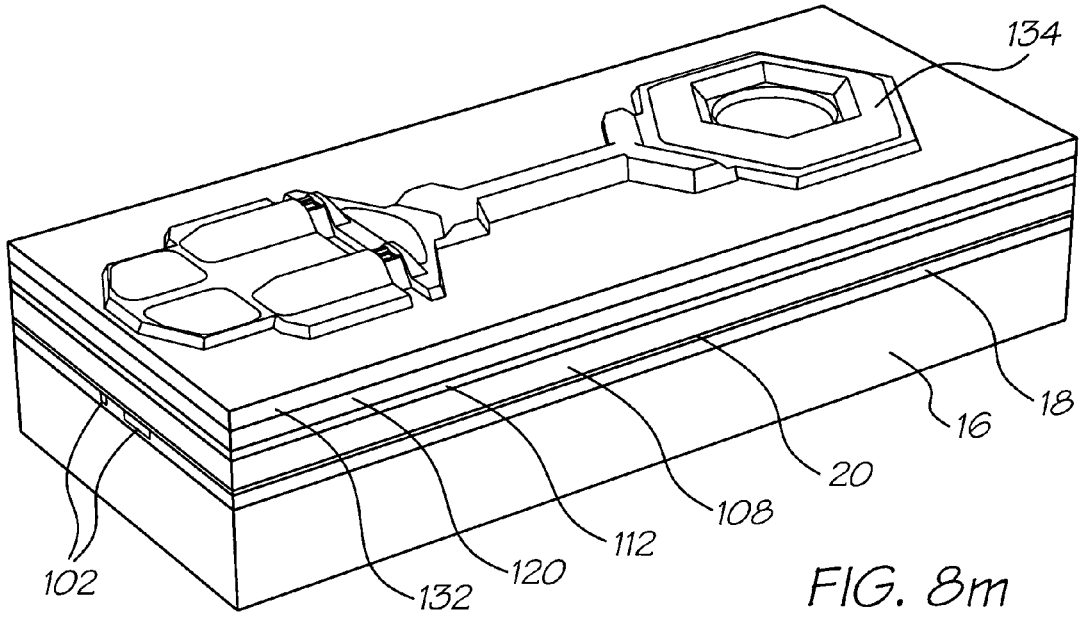
Figure 8N:
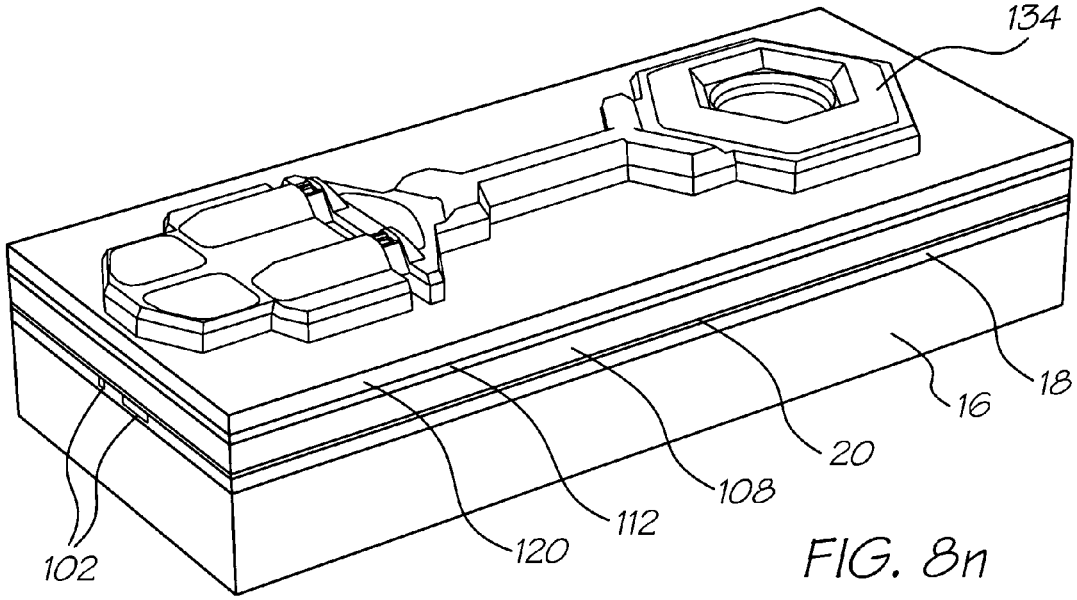
Figure 8O:
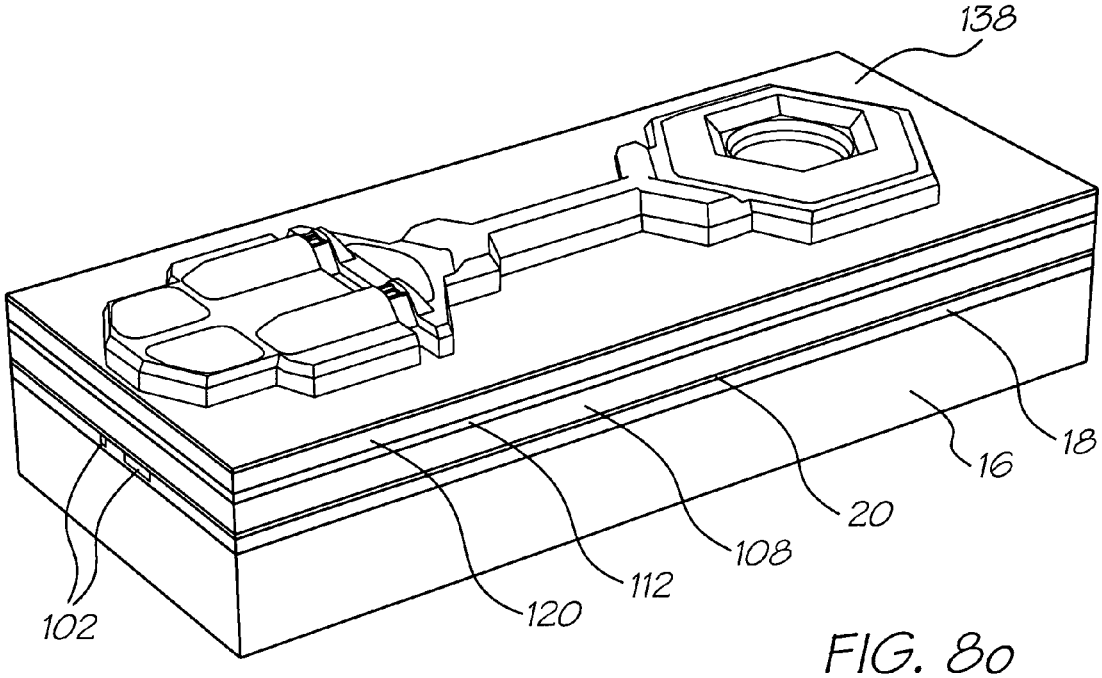
Figure 8P:
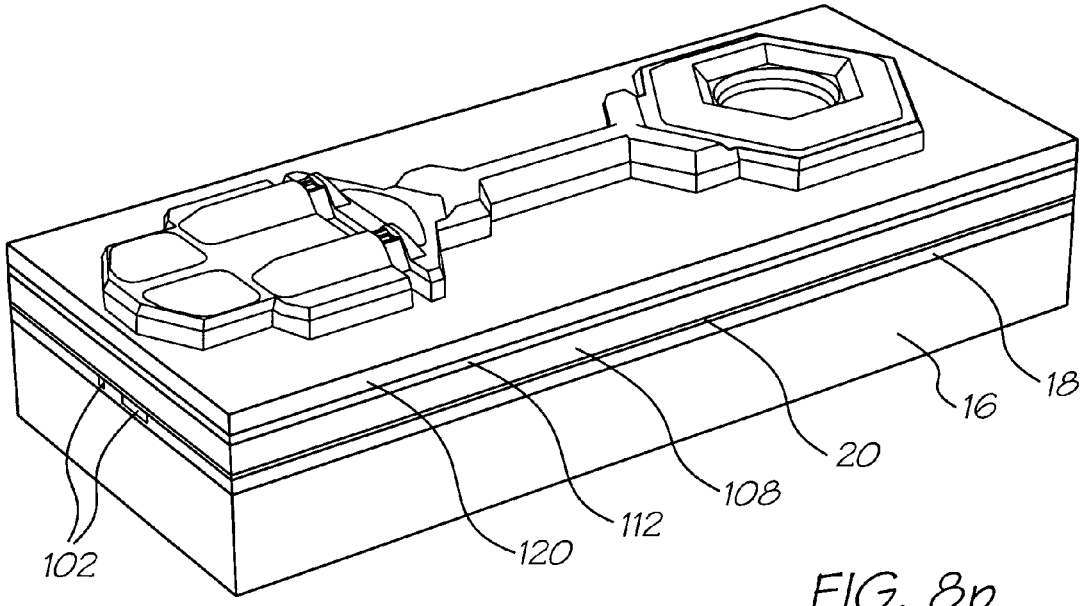
Figure 9P:
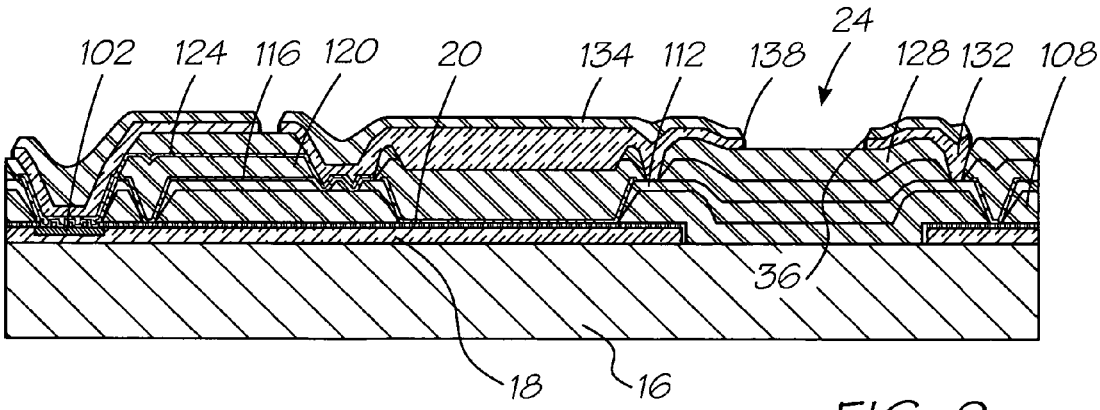
Figure 8Q:
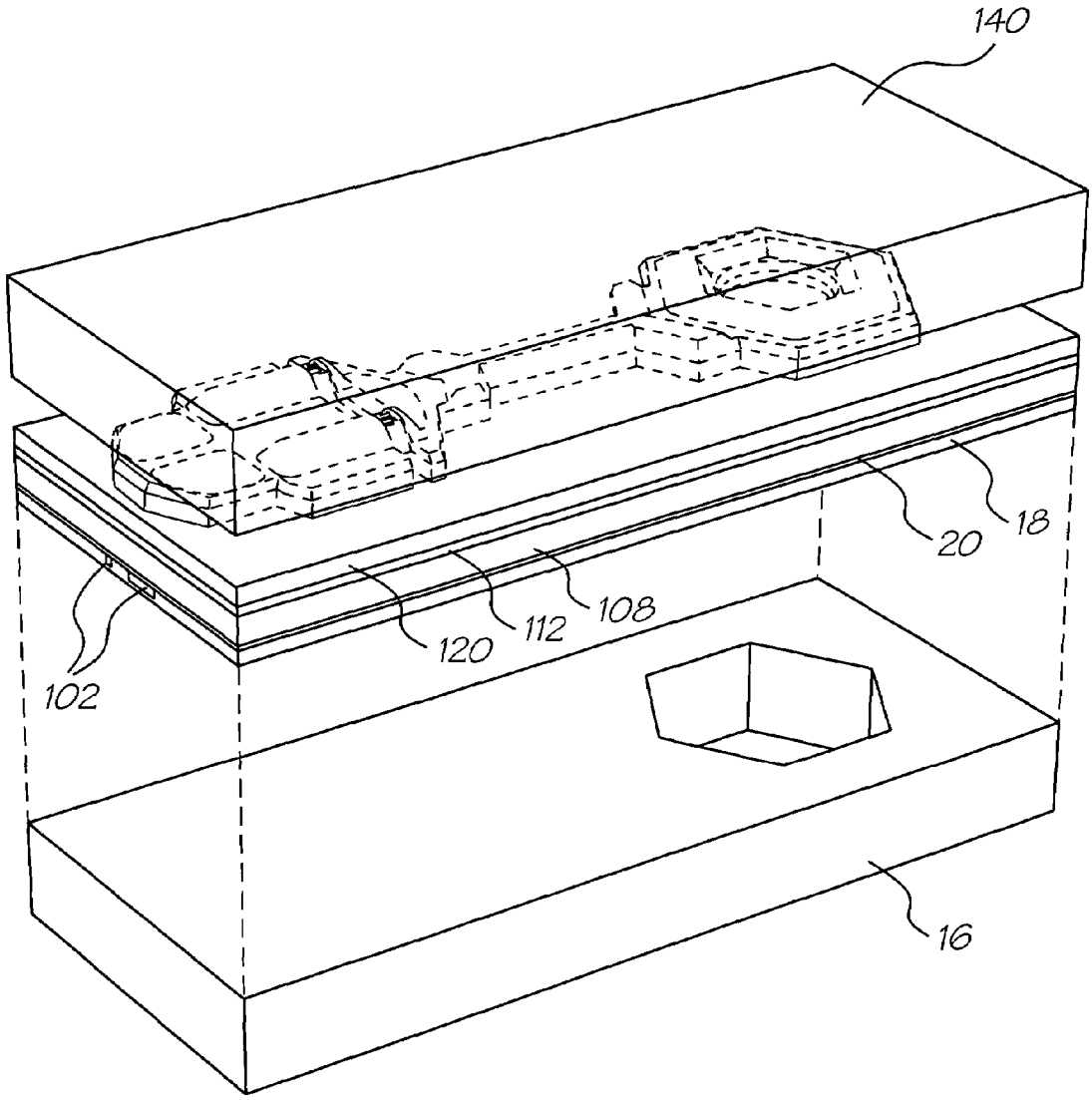
Figure 9Q:
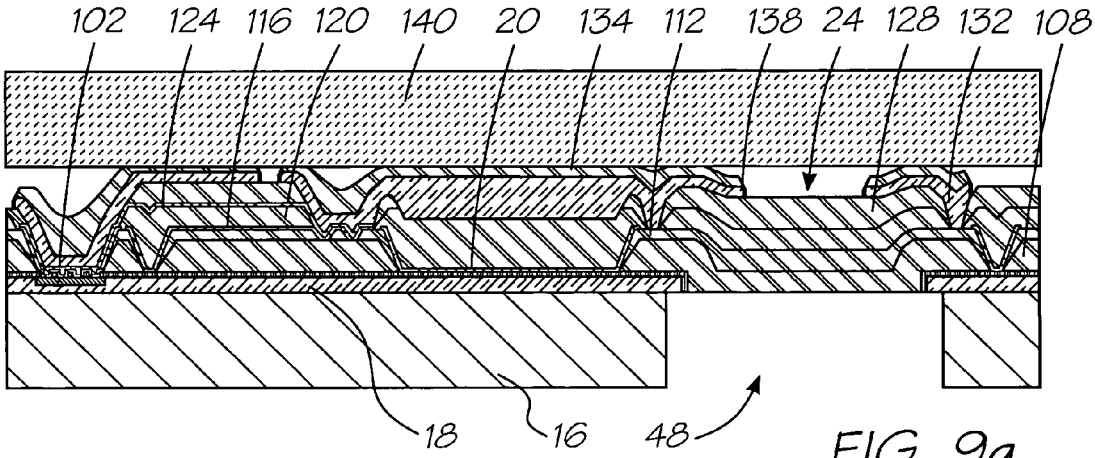
Figure 10K:
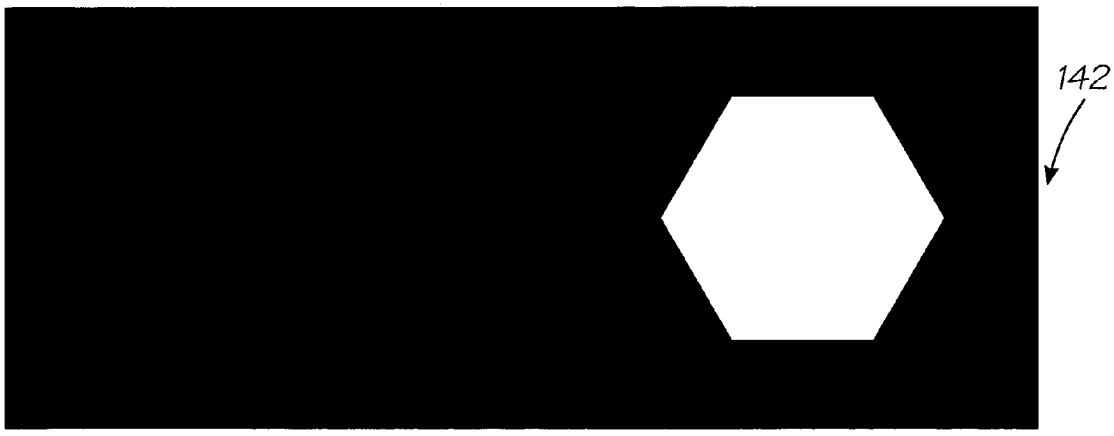

Then, as shown in FIG. 8*p* of the drawings, the layer 138 is anisotropically plasma etched to a depth of 0.35 microns. This etch is intended to clear the dielectric from the entire surface except the side walls of the dielectric layer 132 and the sacrificial layer 134. This step creates the nozzle rim 36 around the nozzle opening 24 which "pins" the meniscus of ink, as described above.

An ultraviolet (UV) release tape 140 is applied. 4 μm of resist is spun on to a rear of the silicon wafer 16. The wafer 16 is exposed to mask 142 to back etch the wafer 16 to define the ink inlet channel 48. The resist is then stripped from the wafer 16.

Figure 8R:
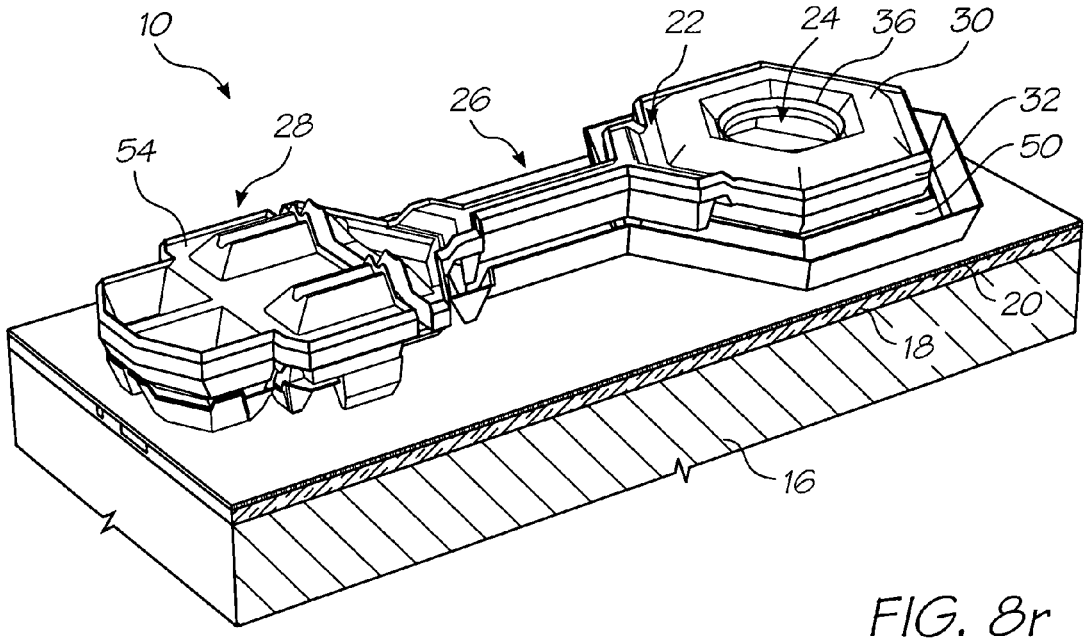
Figure 9R:
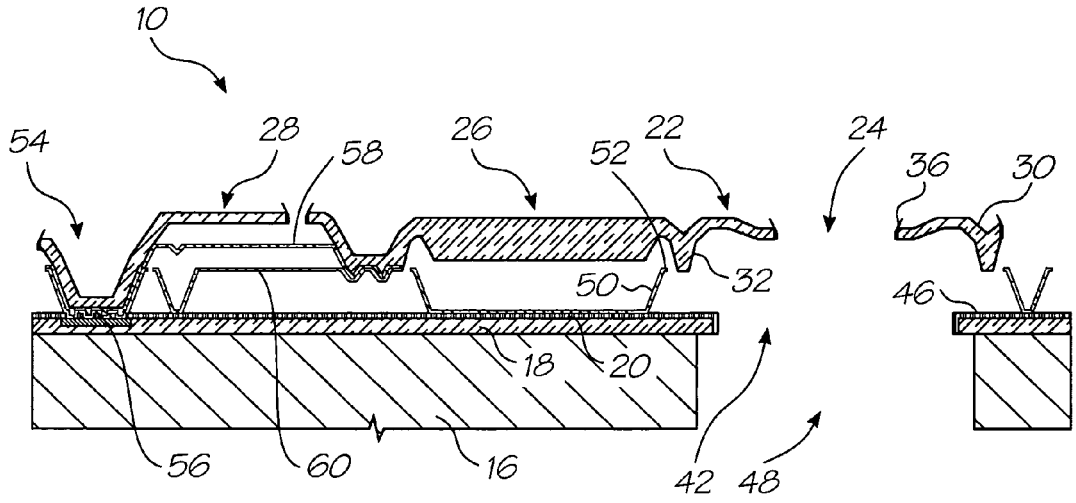
Figure 11A:
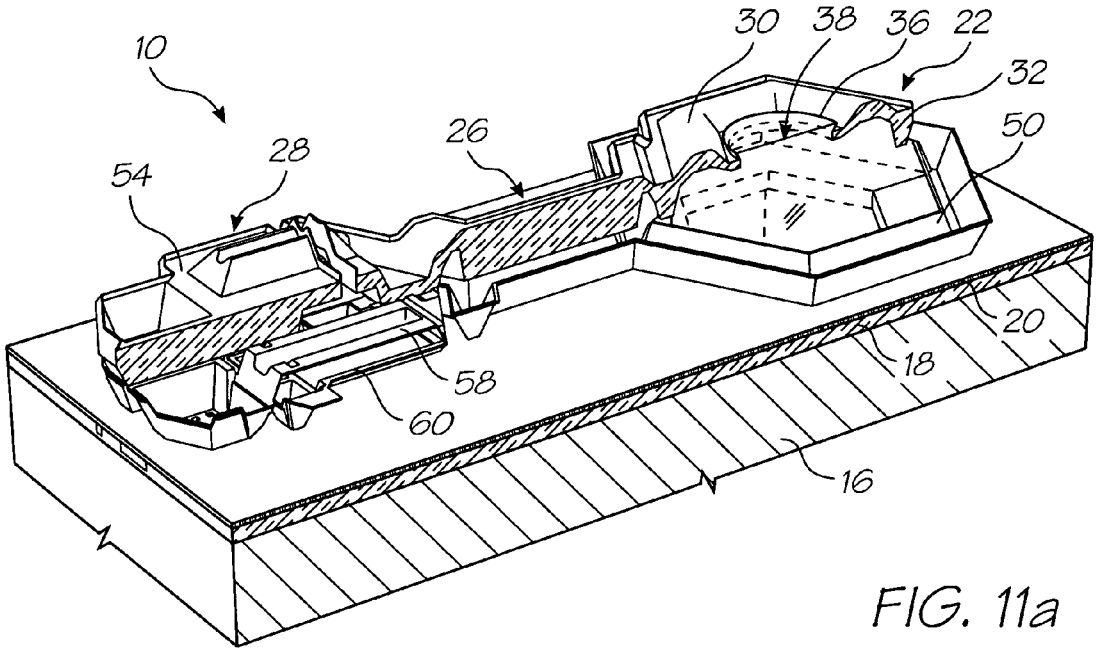
FIGS. 11*a* to 11*c* show three dimensional views of an operation of the nozzle assembly manufactured according to the method of FIGS. 8 and 9.
Figure 12A:
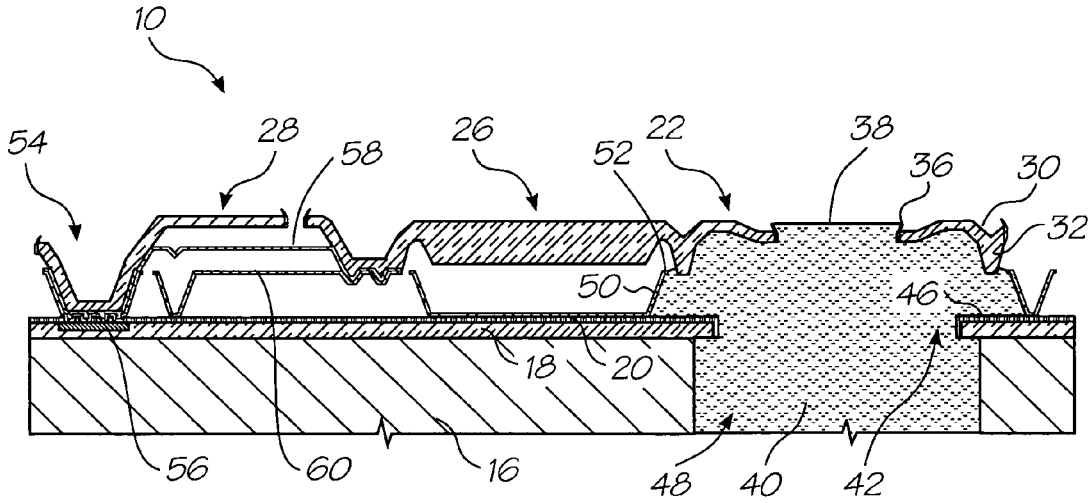
FIGS. 12*a* to 12*c* show sectional side views of an operation of the nozzle assembly manufactured according to the method of FIGS. 8 and 9.
Figure 11B:
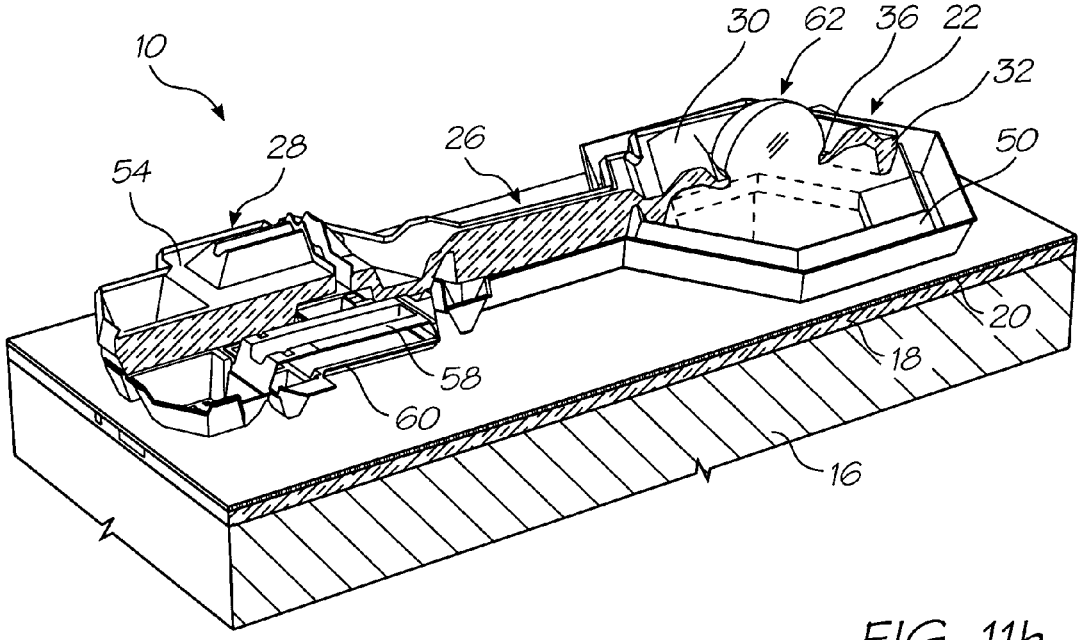
Figure 12B:
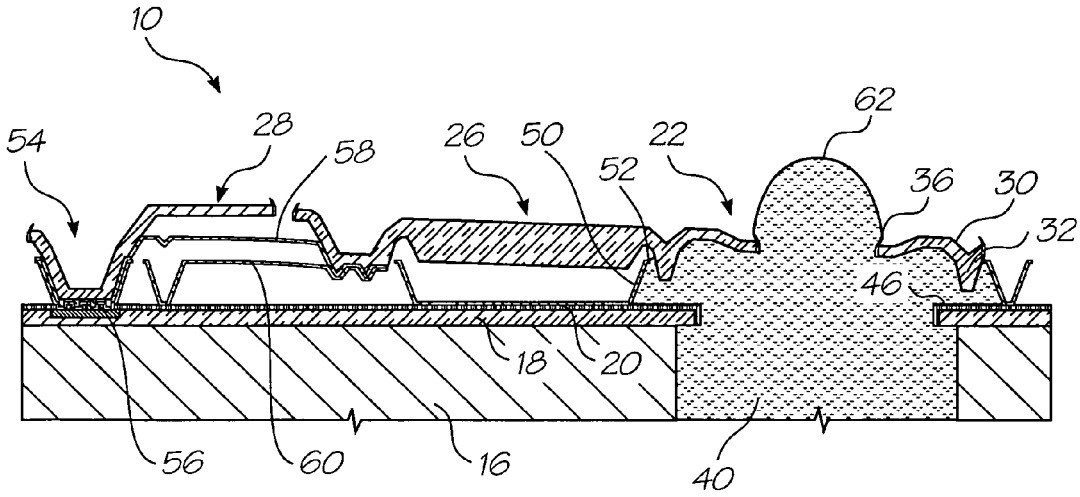
Figure 11C:
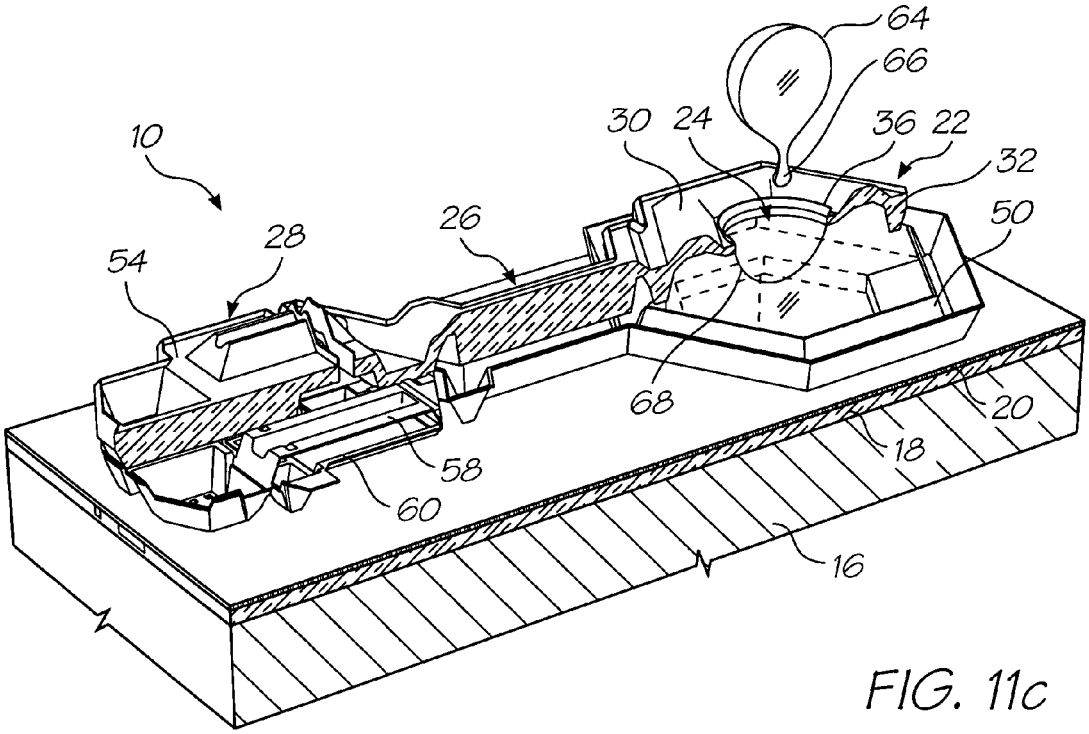
Figure 12C:
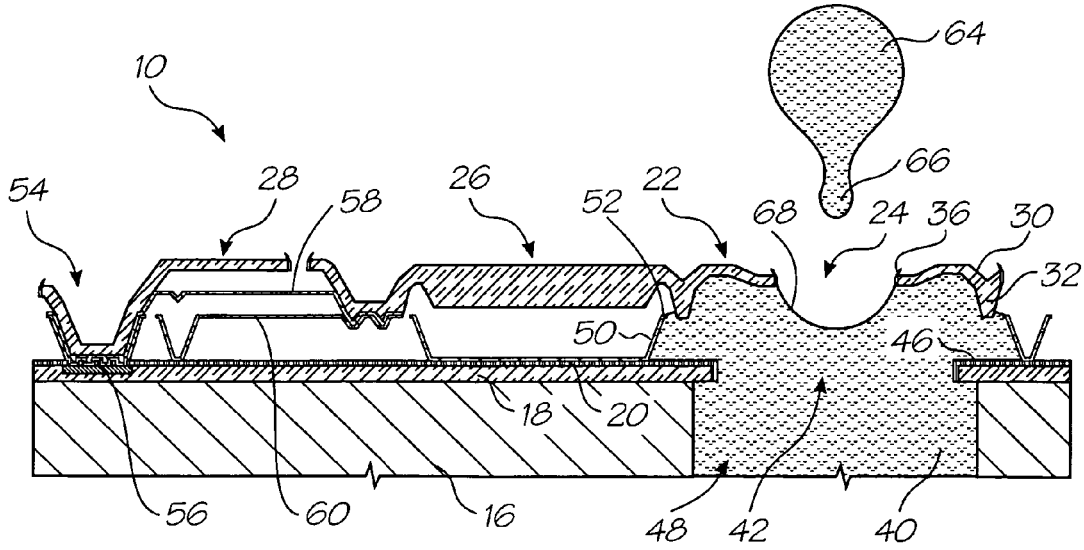

A further UV release tape (not shown) is applied to a rear of the wafer 16 and the tape 140 is removed. The sacrificial layers 108, 112, 120, 128 and 134 are stripped in oxygen plasma to provide the final nozzle assembly 10 as shown in FIGS. 8*r* and 9*r* of the drawings. For ease of reference, the reference numerals illustrated in these two drawings are the same as those in FIG. 1 of the drawings to indicate the relevant parts of the nozzle assembly 10. FIGS. 11 and 12 show the operation of the nozzle assembly 10, manufactured in accordance with the process described above with reference to FIGS. 8 and 9 and these figures correspond to FIGS. 2 to 4 of the drawings.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A micro-electromechanical integrated circuit device which comprises a substrate that defines a plurality of fluid inlet channels;

drive circuitry positioned on the substrate;

a plurality of fixed nozzle chamber walls positioned on the substrate about respective fluid inlet channels;

a plurality of movable nozzle chamber structures positioned over respective nozzle chamber walls so that nozzle chambers are defined by the nozzle chamber walls and the nozzle chamber structures, the nozzle chambers being in fluid communication with respective fluid inlet channels and the nozzle chamber structures each defining a fluid ejection port;

a plurality of elongate actuators, each elongate actuator being fast at one end with the substrate to receive electrical signals from the drive circuitry and fast at an opposite end with a respective nozzle chamber structure so that, on receipt of an electrical signal, the actuators are operable to displace the movable nozzle chamber structures towards and away from the substrate so that fluid is ejected from the fluid ejection ports; and a nozzle guard mounted on the substrate in spaced relationship to the substrate, the nozzle guard defining a plurality of fluid passages that are substantially aligned with respective fluid ejection ports so that fluid ejected from the fluid ejection ports can pass through the nozzle guard, and wherein the nozzle guard and the substrate have a substantially matching coefficient of thermal expansion.

2. A micro-electromechanical integrated circuit device as claimed in claim 1, in which each nozzle chamber structure includes a crown portion that defines the fluid ejection port and a skirt portion that depends from the crown portion.

3. A micro-electromechanical integrated circuit device as claimed in claim 2, in which each skirt portion and associated nozzle chamber wall are configured so that, when the nozzle chambers are filled with fluid, a fluidic seal is set up between the skirt portion and the nozzle chamber wall to inhibit egress of fluid from between the skirt portion and nozzle chamber wall during operation.

4. A micro-electromechanical integrated circuit device as claimed in claim 1, in which each actuator includes an active beam and a passive beam interposed between the active beam and the passive beam, the active beam being connected to the drive circuitry to receive an electrical signal to undergo thermal expansion and contraction independently of the passive beam so that the actuator is bent towards and away from the substrate.

5. A micro-electromechanical integrated circuit device as claimed in claim 1, in which the nozzle guard is mounted on the substrate with struts, the struts and the fluid passages defining airways so that air can be charged through the fluid passages.

6. A micro-electromechanical integrated circuit device as claimed in claim 1, wherein the nozzle guard and the substrate are of substantially the same material.

* * * * *